US010533242B2

(12) United States Patent
Kohtake et al.

(10) Patent No.: US 10,533,242 B2
(45) Date of Patent: Jan. 14, 2020

(54) STEEL FOR COLD FORGING

(71) Applicant: NIPPON STEEL & SUMITOMO METAL CORPORATION, Tokyo (JP)

(72) Inventors: Takahiko Kohtake, Amagasaki (JP); Kazuto Kawakami, Kisarazu (JP); Makoto Okonogi, Chiba (JP)

(73) Assignee: NIPPON STEEL CORPORATION, Tokyo (JP)

( * ) Notice: Subject to any disclaimer, the term of this patent is extended or adjusted under 35 U.S.C. 154(b) by 482 days.

(21) Appl. No.: 15/317,898

(22) PCT Filed: Jun. 13, 2014

(86) PCT No.: PCT/JP2014/065721

§ 371 (c)(1),
(2) Date: Dec. 9, 2016

(87) PCT Pub. No.: WO2015/189978

PCT Pub. Date: Dec. 17, 2015

(65) Prior Publication Data

US 2017/0114434 A1 Apr. 27, 2017

(51) Int. Cl.
*C22C 38/44* (2006.01)
*C21D 1/32* (2006.01)
(Continued)

(52) U.S. Cl.
CPC ..... *C22C 38/44* (2013.01); *C21D 1/32* (2013.01); *C21D 9/525* (2013.01); *C22C 38/001* (2013.01);
(Continued)

(58) Field of Classification Search
CPC ..... C22C 38/00; C22C 38/001; C22C 38/004; C22C 38/02; C22C 38/04; C22C 38/06; C22C 38/08; C22C 38/12; C22C 38/14; C22C 38/18; C22C 38/22; C22C 38/24; C22C 38/28; C22C 38/32; C22C 38/38; C22C 38/40; C22C 38/44; C22C 38/46; C22C 38/50; C22C 38/58;
(Continued)

(56) References Cited

U.S. PATENT DOCUMENTS

2013/0220490 A1 8/2013 Hayashi et al.
2014/0326369 A1 11/2014 Yamashita et al.

FOREIGN PATENT DOCUMENTS

JP 60-9832 A 1/1985
JP 2-6809 B2 2/1990
(Continued)

OTHER PUBLICATIONS

Chinese Office Action and Search Report, dated Nov. 16, 2017, for counterpart Chinese Application No. 201480079763.8, with an English translation.
(Continued)

*Primary Examiner* — Alexandra M Moore
(74) *Attorney, Agent, or Firm* — Birch, Stewart, Kolasch & Birch, LLP

(57) ABSTRACT

A steel contains, in a chemical composition, C, Si, Mn, and Al, and contains pearlite as a metallographic structure, and a value obtained by dividing an Mn content in a cementite in the pearlite in terms of at % by an Mn content in a ferrite in the pearlite in terms of at % is higher than 0 and equal to or lower than 5.0.

20 Claims, 1 Drawing Sheet

(51) Int. Cl.

| | |
|---|---|
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| *C21D 8/06* | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C21D 8/06* (2013.01); *C21D 9/52* (2013.01); *C21D 2211/002* (2013.01); *C21D 2211/003* (2013.01); *C21D 2211/004* (2013.01); *C21D 2211/005* (2013.01); *C21D 2211/008* (2013.01); *C21D 2211/009* (2013.01)

(58) Field of Classification Search
CPC ..... C21D 2211/002; C21D 2211/003; C21D 2211/004; C21D 2211/005; C21D 2211/008; C21D 2211/009; C21D 1/32; C21D 9/52; C21D 9/525; C21D 8/06
See application file for complete search history.

(56) References Cited

FOREIGN PATENT DOCUMENTS

| | | | |
|---|---|---|---|
| JP | 2004-137564 | A | 5/2004 |
| JP | 2006-225701 | A | 8/2006 |
| JP | 2009-275252 | A | 11/2009 |
| JP | 2010-159476 | A | 7/2010 |
| JP | 2013-147728 | A | 8/2013 |
| WO | WO 2011/062012 | A1 | 5/2011 |
| WO | WO 2012/053637 | A1 | 4/2012 |
| WO | WO 2013/094475 | A1 | 6/2013 |
| WO | WO 2014/030327 | A1 | 2/2014 |

OTHER PUBLICATIONS

Korean Notice of Allowance, dated Oct. 4, 2018, for counterpart Korean Application No. 10-2016-7034847, with an English translation.

International Search Report for PCT/JP2014/065721 (PCT/ISA/210) dated Sep. 9, 2014.

Written Opinion of the International Searching Authority for PCT/JP2014/065721 (PCT/ISA/237) dated Sep. 9, 2014.

STEEL FOR COLD FORGING

TECHNICAL FIELD OF THE INVENTION

The present invention relates to a steel having a pearlitic structure (a layered structure of ferrite and cementite), and relates to a steel capable of reducing a treatment time for cementite spheroidizing treatment performed to improve cold workability.

Compared to hot forging, cold forging causes excellent dimensional accuracy when a machine part such as a bolt is formed and excellent productivity. Therefore, there has been a transition from hot forging to cold forging as a production method of a machine part. However, during cold forging in which working is performed at room temperature, the deformation resistance of a steel is high and a high load is applied to a die. Therefore, a steel provided for cold forging requires excellent cold workability (cold forgeability). Here, being excellent in cold workability means that the deformation resistance of a steel is low and the deformability of the steel is high. In general, a steel provided for cold forging is subjected to cementite spheroidizing treatment for softening the steel before the cold forging in order to improve cold workability.

For example, spheroidizing treatment (annealing treatment) of cementite is performed on various kinds of steels such as thin steel sheets and rail steels. As described above, a steel for cold forging (steel wire rod) which is worked into a machine part such as a bolt or nut is subjected to spheroidizing treatment in order to improve cold workability.

As the spheroidizing treatment of cementite, (a) a method of retaining a steel at a temperature of immediately below 727° C. which is the A1 point in the Fe—C binary phase diagram, (b) a method of heating a steel to a temperature of the A1 point or higher and thereafter slowly cooling the steel, and the like are present. In the method of retaining the steel at a temperature of immediately below the A1 point in the Fe—C binary phase diagram in (a), that is, in a method of retaining a steel in a dual-phase region of ferrite+cementite, cementite contained in pearlite is directly spheroidized from pearlite as an initial structure or pearlite+proeutectoid ferrite. This method has been generally widely performed on a steel for cold forging such as medium carbon steel.

On the other hand, machine parts such as a bolt or nut requires high strength. Therefore, for the purpose of improving hardenability, alloying elements such as Mn and Cr are contained in a steel for cold forging.

However, it has been hitherto widely known that the alloying elements contained in the steel for cold forging such as Mn and Cr delay a treatment time for cementite spheroidization. In a case where Mn or Cr is contained in a steel, due to the delay action, a treatment time of about 18 hours is necessary for retaining the steel at a temperature of immediately below the A1 point and spheroidizing cementite. When the treatment time of spheroidizing treatment can be shortened, the productivity of machine parts can be improved, and energy cost during spheroidizing treatment can be reduced.

In order to shorten the spheroidizing treatment time, in the related art, efforts according to various methods have been made. For example, rough wire drawing with an area reduction of 20% to 30% is a performed on a steel before spheroidizing treatment. In this method, cementite is broken during the wire drawing before spheroidizing treatment, and thus spheroidization of cementite is promoted during the spheroidizing treatment. However, in this method, although the spheroidizing treatment time is shortened, the steel is insufficiently softened during the spheroidizing treatment, and thus production costs of machine parts increase. In addition, since the rough wire drawing is necessary before the spheroidizing treatment, production processes become complex.

Otherwise, in order to shorten the spheroidizing treatment time, a steel is subjected to metallographic structure control. For example, Patent Document 1 discloses a method of finely dispersing cementite by controlling a metallographic structure to form bainite. In a case where the metallographic structure of a steel is pearlite, cementite is present in a sheet-shaped morphology. Therefore, in order to spheroidize the cementite, a process of causing the cementite to be melted and precipitate is necessary. In addition, in a case where the metallographic structure of a steel is martensite, cementite is completely solid-soluted into the martensite. Therefore, a process of cementite nucleation is necessary in order to spheroidize the cementite. That is, in a case where the metallographic structure of a steel is pearlite or martensite, in order to spheroidize cementite, a long spheroidizing treatment time is necessary. Therefore, in Patent Document 1, during the production of the steel, the steel is rapidly cooled to a predetermined temperature range from a hot rolling end temperature to a martensite formation temperature or higher and a pearlite formation temperature or lower, and the steel is subjected to isothermal transformation at the temperature. In this method, the metallographic structure of the steel is controlled to form bainite that is an intermediate microstructure between pearlite and martensite, and cementite is finely dispersed in the metallographic structure. Therefore, spheroidization of cementite is promoted during spheroidizing treatment.

Patent Document 2 discloses a method of controlling the metallographic structure of a steel to be a microstructure in which finely dispersed proeutectoid ferrite, fine pearlite, and bainite or martensite coexist. In Patent Document 2, during the production of the steel, the steel is rapidly cooled from a first finish rolling end temperature to a temperature range of 500° C. to 850° C., a plastic strain of 20% to 80% is applied to the steel by a second finishing mill, and the resultant is cooled from a second finish rolling end temperature to 500° C. at a cooling rate of 0.15 to 10° C./s and is rapidly cooled to a temperature of 500° C. or lower at 10° C./s or higher. In this method, the metallographic structure of the steel is controlled to be the coexisting microstructure and thus the fraction of grain boundaries increases. Therefore, during spheroidizing treatment, the diffusion rate of carbon increases, and thus spheroidization of cementite is promoted.

As described above, in the technique disclosed in Patent Document 1 or Patent Document 2, the spheroidizing treatment time of cementite is shortened. However, in the steel disclosed in Patent Document 1 or Patent Document 2, most of the metallographic structure is bainite or martensite. Therefore, there is a problem in that the deformation resistance of the steel is high.

Patent Document 3 discloses a steel in which the metallographic structure is controlled to include degenerate-pearlite, and bainite or ferrite for the purpose of shortening a spheroidizing treatment time and reducing the deformation resistance of the steel. Degenerate-pearlite is pearlite containing cementite in a granular or broken sheet-shaped form. Therefore, in the steel disclosed in Patent Document 3, spheroidization of the cementite is promoted during spheroidizing treatment. Simultaneously, since the metallographic structure contains ferrite, the deformation resistance thereof is reduced.

Patent Document 4 discloses a steel in which the metallographic structure is controlled to be a structure in which proeutectoid ferrite of which the volume fraction is suppressed, a structure with broken cementite (carbide) such as bainite or a pearlitic structure with a small aspect ratio, and pearlite with fine block sizes and lamellar spacings coexist for the purpose of shortening a spheroidizing treatment time and reducing the deformation resistance of the steel. In the steel disclosed in Patent Document 4, since the cementite is refined, spheroidization of the cementite is promoted during spheroidizing treatment. Simultaneously, since the fraction or morphology of each of the constituent phases is controlled, the deformation resistance is reduced.

As disclosed in Patent Document 1 to 4, in the related art, as a method of controlling cementite to have an easily spheroidized morphology, a technique of transforming the metallographic structure of a steel from pearlite to bainite and the like has been examined. However, as described above, in the method described in Patent Document 1 or Patent Document 2, since the metallographic structure of the steel primarily contains bainite or martensite, although the spheroidization of cementite is promoted during spheroidizing treatment, the deformation resistance of the steel is insufficiently reduced. In addition, in the method described in Patent Document 3, 10% or more of degenerate-pearlite is necessary as the metallographic structure, and thus there is a limitation on the alloy composition. In addition, in the method described in Patent Document 4, although the spheroidizing treatment time is shortened, a treatment time of several tens of hours is still necessary, and thus a further reduction in the spheroidizing treatment time is required.

As described above, in the related art, it cannot be said that a reduction in a cementite spheroidizing treatment time and an improvement in cold workability are simultaneously and sufficiently achieved. In addition, in the related art, there is not a report that focuses on the amounts of alloying elements such as Mn and Cr contained in each of cementite and ferrite in pearlite and examines the distribution ratio of the alloying elements in the cementite and the ferrite for the purpose of simultaneously achieving a reduction in a cementite spheroidizing treatment time and an improvement in cold workability.

PRIOR ART DOCUMENT

Patent Document

[Patent Document 1] Japanese Unexamined Patent Application, First Publication No. S60-9832

[Patent Document 2] Japanese Unexamined Patent Application, First Publication No. H2-6809

[Patent Document 3] Japanese Unexamined Patent Application, First Publication No. 2006-225701

[Patent Document 4] Japanese Unexamined Patent Application, First Publication No. 2009-275252

DISCLOSURE OF THE INVENTION

Problems to be Solved by the Invention

An object of the present invention is to provide a steel capable of simultaneously achieving a reduction in a spheroidizing treatment time before cold forging and an improvement in cold workability by focusing on alloying elements such as Mn and Cr that have a significant effect on the spheroidizing rate of cementite and by controlling the distribution ratio of the alloying elements in the cementite and ferrite in pearlite before spheroidizing treatment.

Means for Solving the Problem (1) According to an aspect of the present invention, a steel includes, in a chemical composition, by mass %: C: 0.005% to 0.60%, Si: 0.01% to 0.50%, Mn: 0.20% to 1.80%, Al: 0.01% to 0.06%, P: 0.04% or less, S: 0.05% or less, N: 0.01% or less, Cr: 0% to 1.50%, Mo: 0% to 0.50%, Ni: 0% to 1.00%, V: 0% to 0.50%, B: 0% to 0.0050%, Ti: 0% to 0.05%, and a remainder of Fe and impurities, in which a metallographic structure contains a pearlite, and a value obtained by dividing an Mn content in a cementite in the pearlite in terms of at % by an Mn content in a ferrite in the pearlite in terms of at % is higher than 0 and equal to or lower than 5.0.

(2) The steel described in (1) may include, in the chemical composition, by mass %: Cr: 0.02% to 1.50%, in which a value obtained by dividing a Cr content in the cementite in the pearlite in terms of at % by a Cr content in the ferrite in the pearlite in terms of at % may be higher than 0 and equal to or lower than 3.0.

(3) In the steel described in (1) or (2), the metallographic structure may further contain proeutectoid ferrite or bainite, and when a carbon content in the chemical composition by mass % is defined as C, in a cross section perpendicular to a longitudinal direction of the steel, an area fraction of the pearlite may be equal to or higher than 130×C % and lower than 100% and an area fraction of a sum of the proeutectoid ferrite and the bainite may be higher than 0% and equal to or lower than 100-130×C %.

(4) In the steel described in (1) or (2), the metallographic structure may consist of the pearlite.

Effects of the Invention

According to the aspect of the present invention, not only the alloy composition or the metallographic structure of the steel is controlled, but also the distribution ratio of the alloying elements in the cementite and the ferrite in the pearlite of the steel is preferably controlled. Therefore, a reduction in the spheroidizing treatment time before cold forging and an improvement in cold workability can be simultaneously achieved.

Specifically, by preferably controlling the distribution ratio of the alloying elements in the cementite and the ferrite in the pearlite, the spheroidizing treatment time before cold forging is shortened. For example, while a spheroidizing treatment time before cold forging in a general steel is about 18 hours, the spheroidizing treatment time before cold forging in the steel according to the aspect is about 9 hours or shorter. That is, regarding spheroidizing treatment, the treatment time can be shortened to 50% or less, and a reduction in energy cost, an improvement in productivity, and the like can be achieved. Furthermore, in the steel according to the aspect, since the alloy composition and the metallographic structure are simultaneously controlled, cold workability is improved.

As described above, in the related art, in order to simultaneously achieve a reduction in cementite spheroidizing treatment time and an improvement in cold workability, for example, physically breaking cementite by processing a steel before spheroidizing treatment is attempted, or refining and distributing cementite by controlling the metallographic structure of the steel is attempted. However, according to the aspect of the present invention, by preferably controlling the distribution ratio of the alloying elements in the cementite and the ferrite in the pearlite, the material properties of the cementite can be essentially improved. As a result, a steel with the essentially improved spheroidizing treatment time and cold workability can be provided.

EMBODIMENT OF THE INVENTION

Figure 1:
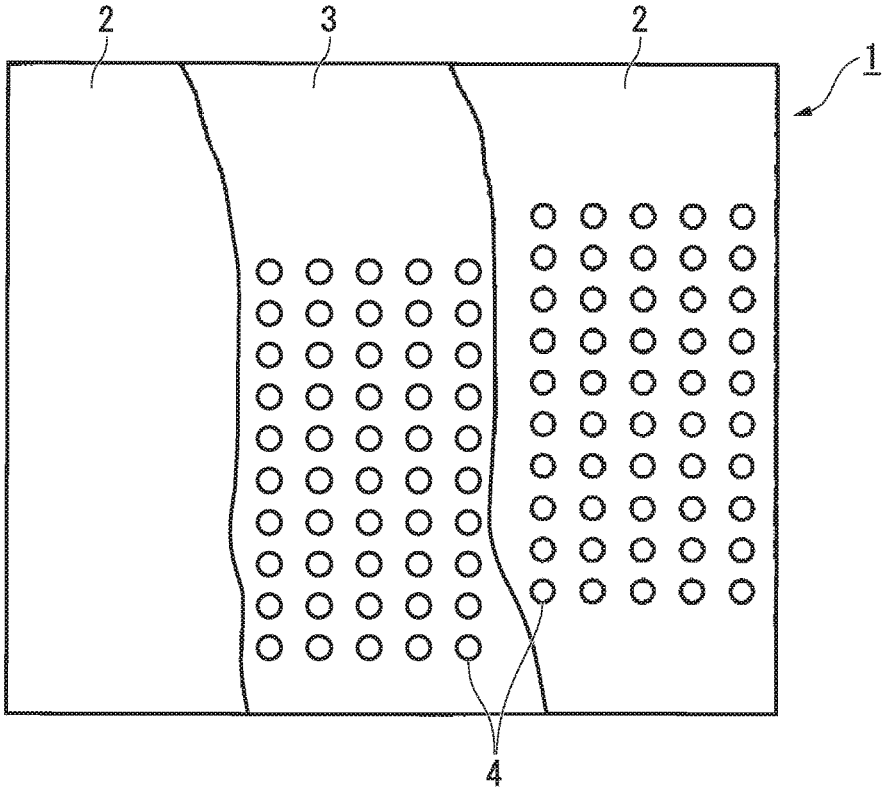
FIG. 1 is an enlarged schematic view showing pearlite contained in a steel according to an embodiment of the present invention, and is a schematic view showing measurement points for elemental analysis in ferrite and cementite in the pearlite.

Hereinafter, preferred embodiments of the present invention will be described in detail. However, the present invention is not limited only to configurations disclosed in the embodiments, and various modifications can be made without departing from the gist of the present invention. In addition, in a numerical value limitation range described below, the lower limit and the upper limit are included in the range. However, a numerical value limitation range with "higher than" the lower limit does not include the lower limit, and a numerical value limitation range with "lower than" the upper limit does not include the upper limit.

Typically, a pearlitic steel is produced as follows. A steel is heated to a temperature of 1000° C. or higher, the steel is hot-rolled into a hot rolled material, the hot rolled material is wound at about 750° C. to 1000° C., and the wound hot rolled material is cooled from the winding temperature to a heat treatment temperature (about 650° C. to 550° C.) at which pearlite forms, the hot rolled material is retained at this heat treatment temperature to complete pearlitic transformation and form a pearlitic steel, and the pearlitic steel is cooled to room temperature. Otherwise, a steel is hot-rolled into a hot rolled material, the hot rolled material is wound at about 750° C. to 1000° C., the wound hot rolled material is subjected to continuous cooling from the winding temperature to room temperature to complete pearlitic transformation and form a pearlitic steel. Instead of cooling the hot rolled material after the hot rolling to room temperature and reheating the hot rolled material to the pearlitic transformation temperature, cooling the hot rolled material after the hot rolling to a pearlitic transformation temperature so as to be directly subjected to pearlitic transformation can reduce production costs for reheating.

On the other hand, the steel according to this embodiment is produced as follows as an example. A steel which satisfies a chemical composition, which will be described later, is heated to a temperature of 1000° C. or higher, the steel is hot-rolled into a hot rolled material, the hot rolled material is wound in a temperature range of 750° C. to 1000° C., the wound hot rolled material is subjected to primary cooling (rapid cooling) from a winding end temperature to 700° C. under the condition in which an average cooling rate is 70° C./s to 300° C./s, the hot rolled material after the primary cooling is subjected to secondary cooling (slow cooling) in a temperature range from 700° C. to 550° C. to 450° C. under the condition in which an average cooling rate is 20° C./s to 35° C./s, the hot rolled material after the secondary cooling is retained to complete pearlitic transformation in a temperature range of 550° C. to 450° C. under the condition in which a retention time is 20 seconds to 200 seconds to form a steel, and the steel after the retention is subjected to tertiary cooling from a retention end temperature to room temperature under the condition that the average cooling rate is 25° C./s to 50° C./s.

Since the steel according to this embodiment is produced under the production conditions described above as an example, the distribution ratio of alloying elements contained in each of cementite and ferrite in pearlite is preferably controlled. Specifically, regarding Mn (manganese) contained in the steel according to this embodiment, a value (hereinafter, called a Mn distribution ratio) obtained by dividing the Mn content in cementite in pearlite in terms of at % by the Mn content in ferrite in the pearlite in terms of at % is controlled to be higher than 0 and equal to or lower than 5.0. In addition, in a case where Cr (chromium) is contained in the steel according to this embodiment, a value (hereinafter, called a Cr distribution ratio) obtained by dividing the Cr content in the cementite in the pearlite in terms of at % by the Cr content in the ferrite of the pearlite in terms of at % is controlled to be higher than 0 and equal to or lower than 3.0.

In addition, the steel according to this embodiment may be subjected to cementite spheroidizing treatment as follows. The steel may be heated from room temperature at a heating rate of about 180° C./h, the steel after being heated may be subjected to isothermal retention in a temperature range of 680° C. to 720° C. immediately below the A1 point in the Fe—C binary phase diagram. As the spheroidizing treatment temperature (isothermal retention temperature) is closer to 727° C. which is the A1 point in the Fe—C binary phase diagram in the temperature range, the treatment time until spheroidization of the cementite ends is shortened. As the spheroidizing treatment temperature decreases in the temperature range, the treatment time until spheroidization of the cementite ends is lengthened. In consideration of productivity, it is preferable that the steel is subjected to spheroidizing treatment at a temperature of 680° C. or higher.

Hereinafter, details that lead to the achievement of the steel according to this embodiment will be described.

Hitherto, regarding Ostwald growth of cementite, it is known that as the equilibrium distribution coefficients of alloying elements such as Mn and Cr increase at a heat treatment temperature, the growth rate decreases. Similarly, regarding spheroidization of cementite associated with the Ostwald growth, it is analyzed that depending on the equilibrium distribution coefficients of the alloying elements such as Mn and Cr in the cementite and ferrite in pearlite at a spheroidizing treatment temperature, the spheroidizing rate is determined. That is, on the assumption that the Mn distribution ratio, the Cr distribution ratio, and the like at a spheroidizing treatment temperature are close to an equilibrium state, the spheroidizing rate has been examined. On the other hand, a case where the Mn distribution ratio, the Cr distribution ratio, and the like at a spheroidizing treatment temperature are in non-equilibrium has not been hitherto examined.

In a case of an equilibrium state at a spheroidizing treatment temperature, Mn, Cr, and the like which are the alloying elements are contained in higher proportions in cementite in pearlite than in ferrite in the pearlite. That is, in the case of an equilibrium state at a spheroidizing treatment temperature, the Mn distribution ratio, the Cr distribution ratio, and the like have high values. However, the inventors experimentally confirmed that depending on the production conditions, there may be case where Mn, Cr, and the like contained in cementite in pearlite have distribution ratios in non-equilibrium in which the amounts thereof are lower than those of an equilibrium composition, that is, there may be a case where the Mn distribution ratio, the Cr distribution ratio, and the like have lower values than those in the equilibrium state. In addition, it was found that in a case where the Mn distribution ratio, the Cr distribution ratio, and the like have lower values than those in the equilibrium state at a spheroidizing treatment temperature, there is a possibility that the spheroidizing treatment time of cementite may be shortened.

The inventors examined the relationship between the Mn distribution ratio or the Cr distribution ratio at a spheroidizing treatment temperature and the spheroidizing rate of cementite through a simulation. As a result, it was found that as the Mn distribution ratio or the Cr distribution ratio has lower values than those in the equilibrium state, a time needed for spheroidization of cementite is significantly reduced.

In addition, in practice, when it could be seen that through an experiment, it can be confirmed that the simulation results and experimental results have the same tendency. In a case where the Mn distribution ratio or the Cr distribution ratio has lower values than those in the equilibrium state, compared to a case where the Mn distribution ratio or the Cr distribution ratio is in the equilibrium state, the treatment time for cementite spheroidization is shortened to half or less. On the basis of the results, it was found that by controlling pearlite contained in the metallographic structure of the steel to be pearlite in which the Mn distribution ratio, the Cr distribution ratio, and the like have lower values than those in the equilibrium state, a steel capable of shortening the spheroidizing treatment time of the cementite can be obtained.

Hereinafter, a mechanism for shortening the spheroidizing treatment time by controlling the Mn distribution ratio (Mn in terms of at % contained in cementite in pearlite÷Mn in terms of at % contained in ferrite in the pearlite), the Cr distribution ratio (Cr in terms of at % contained in the cementite in the pearlite÷Cr in terms of at % contained in the ferrite in the pearlite), and the like to have lower values than those in an equilibrium state is estimated.

In a spheroidizing process of cementite, C (carbon) is liquidated out from the end of cementite in pearlite. That is, as C diffuses to ferrite from the cementite, the morphology of the cementite becomes close to a spherical shape. However, when Mn, Cr, and the like are contained in the cementite, for spheroidization of the cementite, Mn, Cr, and the like need to diffuse to the ferrite from the cementite. In a steel in which the Mn distribution ratio, the Cr distribution ratio, and the like before spheroidizing treatment are close to those in an equilibrium state, the amounts of Mn, Cr, and the like in cementite in pearlite have higher values than those in ferrite in the pearlite. In the steel, in the spheroidizing process, a time is needed for Mn, Cr, and the like to diffuse to the ferrite from the cementite, and as a result, the spheroidizing treatment time is lengthened. On the other hand, it is estimated that in a steel in which the Mn distribution ratio, the Cr distribution ratio, and the like before spheroidizing treatment have lower values than those in the equilibrium state, in the spheroidizing process, a frequency at which Mn, Cr, and the like diffuse to the ferrite from the cementite decreases, the spheroidizing rate consequently increases, and thus the spheroidizing treatment time is reduced.

Next, conditions for controlling the Mn distribution ratio, the Cr distribution ratio, and the like in the steel according to this embodiment will be described.

A method of controlling the Mn distribution ratio, the Cr distribution ratio, and the like in the steel according to this embodiment is not particularly limited. As long as the Mn distribution ratio, the Cr distribution ratio, and the like are controlled to have lower values than those in an equilibrium state, the steel may be produced according to any production method. For example, the steel may be produced under the above-described production conditions, and the Mn distribution ratio, the Cr distribution ratio, and the like may be controlled. Hereinafter, the above-described production conditions will be described in more detail.

As a heating process, a steel which satisfies a chemical composition, which will be described later, may be heated to a temperature of 1000° C. or higher. Preferably, the steel is heated in a temperature range of 1000° C. to 1200° C. In the heating process, for the purpose of uniformly distributing alloying elements, the steel is preferably heated at the temperature.

As a hot rolling process, in order to obtain a hot rolled material, the steel after the heating process may be hot-rolled. The hot rolling conditions are not particularly limited. The steel after the heating process may be hot-rolled into a desired shape.

As a winding process, the hot rolled material after the hot rolling process may be wound in a temperature range of 750° C. to 1000° C. In the winding process, when the winding temperature is lower than 750° C., it becomes difficult to wind the steel into a ring shape. When the winding temperature is higher than 1000° C., oxidized scale increases, resulting in a deterioration in yield. Therefore, it is preferable that the hot rolled material is wound in the temperature range.

As a primary cooling process, the hot rolled material after the winding process may be subjected to primary cooling (rapid cooling) from a winding end temperature to 700° C. under the condition that an average cooling rate is 70° C./s to 300° C./s. In a temperature range from the winding end temperature to 700° C., in addition to a possibility that pearlite may form during cooling, the diffusion rate of alloying elements such as Mn, Cr, and the like is high. Therefore, by causing the average cooling rate in this temperature range to be 70° C./s or higher, diffusion of Mn, Cr, and the like to cementite in the pearlite can be preferably suppressed. On the other hand, at an average cooling rate of 300° C./s or higher in this temperature range, the above-described effect is saturated.

As a secondary cooling process, the hot rolled material after the primary cooling process may be subjected to secondary cooling (slow cooling) in a temperature range from 700° C. to 550° C. to 450° C. under the condition that an average cooling rate is 20° C./s to 35° C./s. In the temperature range from 700° C. to 550° C. to 450° C., there is a possibility that bainite may form in a case where a cooling rate during cooling is high. Therefore, by causing the average cooling rate in this temperature range to be 35° C./s or lower, the formation of bainite during cooling can be preferably suppressed. On the other hand, by causing the average cooling rate in this temperature range to be 20° C./s or higher, the diffusion of Mn, Cr, and the like to the cementite in the pearlite can be preferably suppressed.

As a retention (pearlitic transformation) process, in order to obtain a pearlitic steel, the hot rolled material after the secondary cooling process may be retained in a temperature range of 550° C. to 450° C. under the condition that a retention time is 20 seconds to 200 seconds. In the temperature range of 550° C. to 450° C., bainite is less likely to form during the retention, but pearlitic transformation proceeds during the retention. In addition, in the temperature range of 550° C. to 450° C., the diffusion rate of the alloying elements such as Mn and Cr is low. Therefore, in a case where the hot rolled material is retained in this temperature range, the formation of bainite is preferably suppressed while the metallographic structure of the hot rolled material is transformed into pearlite, and excessive diffusion of Mn, Cr, and the like to the cementite in the pearlite can be preferably suppressed.

The retention in the retention process is preferably retention at a constant temperature. In addition, in order to retain the hot rolled material at a constant temperature in the retention process, the hot rolled material may be immersed into a molten salt bath, or the hot rolled material may be retained in a thermostatic furnace. When the retention temperature in the retention process is lower than 450° C., bainite in addition to pearlite forms, and the volume fraction thereof exceeds 20%. Therefore, there is concern that cold workability may be deteriorated. On the other hand, when the retention temperature in the retention process is higher than 550° C., there is concern that Mn, Cr, and the like may excessively diffuse to the cementite in the pearlite. The upper limit of the retention temperature is preferably lower than 520° C., and more preferably equal to or lower than 500° C.

In addition, the retention in the retention process may be preferably performed for a short period of time in order to reduce the time for which Mn, Cr, and the like diffuse. However, when the pearlitic transformation is insufficiently completed, during tertiary cooling after the retention process, martensite forms from austenite that is not transformed into pearlite but is retained, and there is concern that cold workability may be deteriorated. Therefore, it is preferable that the retention in the retention process is performed for 20 seconds or longer. On the other hand, in order to suppress excessive diffusion of Mn, Cr, and the like to the cementite in the pearlite and increase the productivity of the steel, it is preferable that the retention in the retention process is performed for 200 seconds or shorter.

As a tertiary cooling process, the steel after the retention process may be subjected to tertiary cooling from the temperature at the time of the end of the retention to room temperature under the condition that an average cooling rate is 25° C./s to 50° C./s. By causing the average cooling rate in this temperature range to be 25° C./s or higher, diffusion of Mn or Cr to the cementite in the pearlite can be preferably suppressed. By causing the average cooling rate in this temperature range to be 50° C./s or lower, the formation of martensite can be preferably suppressed.

Next, the Mn distribution ratio (Mn in terms of at % contained in cementite in pearlite÷Mn in terms of at % contained in ferrite in the pearlite) of the steel according to this embodiment will be described.

Machine parts require high strength. Therefore, after a steel for cold forging is formed into a machine part, the metallographic structure thereof is controlled to have martensite through hardening. In general, the steel for cold forging contains Mn as an alloying element for enhancing hardenability. However, Mn tends to segregate to cementite in pearlite. For example, at 600° C., the Mn distribution ratio in an equilibrium state is about 11, and at 550° C. which is the pearlitic transformation temperature, the Mn distribution ratio in an equilibrium state is about 25. In a cementite spheroidizing process, Mn needs to diffuse to ferrite and the like from cementite. Therefore, in a case where Mn is contained in the steel, a treatment time for cementite spheroidization increases.

In the steel according to this embodiment, a value (Mn distribution ratio) obtained by dividing the Mn content in cementite in pearlite in terms of at % by the Mn content in ferrite in the pearlite in terms of at % is controlled to be higher than 0 and equal to or lower than 5.0. As a result, a cementite spheroidizing treatment time before cold forging can be shortened. In addition, the Mn distribution ratio is a measurement value at room temperature. When the Mn distribution ratio measured at room temperature is in the above range, the Mn distribution ratio at a spheroidizing treatment temperature of the cementite also becomes a preferable value with which the spheroidizing treatment time can be shortened.

The aspect ratio of the cementite contained in the steel according to this embodiment is higher than 5 on average. In addition, in the steel according to this embodiment, when the aspect ratio of the cementite is caused to be 5 or lower on average by spheroidizing treatment, the cementite is regarded as being spheroidized. In general, in a steel for cold forging in the related art, when the aspect ratio of cementite is caused to be 5 or lower on average by spheroidizing treatment, it is regarded as obtaining sufficient softening. Typically, the steel for cold forging in the related art requires a treatment time of about 18 hours for spheroidization of cementite.

In the steel according to this embodiment, the significant figures of the Mn distribution ratio include one decimal place after a decimal point. For measurement of the Mn distribution ratio through TEM-EDS (Transmission Electron Microscope-Energy Dispersive X-ray Spectroscopy), significant decimal places for the measurement are two decimal places after a decimal point. However, when a spheroidizing treatment time was examined by performing spheroidizing treatment of cementite at a treatment temperature of 700° C., there was no significant difference in the spheroidizing treatment time between a case where the Mn distribution ratio of the steel was 5.00 and a case where the Mn distribution ratio was 5.01. In this case, the spheroidizing treatment time in either case was about 9 hours. Therefore, the significant figures of the Mn distribution ratio are set to include one decimal place after a decimal point. For the same reason, the Cr distribution ratio, which will be described later, also has one decimal place after a decimal point as the significant figures.

In order to check the relationship between the Mn distribution ratio before spheroidizing treatment and the treatment time for cementite spheroidization, a spheroidizing treatment time was examined by performing spheroidizing treatment of cementite at a treatment temperature of 700° C. As a result, in a case of an Mn distribution ratio of 1.0, the spheroidizing treatment time was about 5 hours, and in a case of an Mn distribution ratio of 5.0, the spheroidizing treatment time was about 9 hours. As described above, as the value of the Mn distribution ratio increased, the spheroidizing treatment time also increased. In addition, in a case of an Mn distribution ratio of 5.1, the spheroidizing treatment time was about 9.5 hours. In this embodiment, in a case where the treatment time when spheroidizing treatment is performed in a temperature range of 680° C. to 720° C. was 9 hours or shorter, it is determined that the spheroidizing treatment time is shortened to 50% or less compared to the related art. Therefore, in the steel according to this embodiment, the upper limit of the Mn distribution ratio is set to 5.0.

In order to shorten the spheroidizing treatment time of cementite, a state in which Mn is not contained in the cementite at all is the most preferable. That is, the Mn distribution ratio is ideally 0. However, in a case where Mn is contained in the cementite, Mn becomes energetically stable. That is, it is industrially difficult to set the Mn distribution ratio to 0. Therefore, in the steel according to this embodiment, the lower limit of the Mn distribution ratio is set to be greater than 0. In addition, the lower limit of the Mn distribution ratio is preferably 1.0. In addition, the upper limit of the Mn distribution ratio is less than 2, and more preferably less than 1.5.

In addition, according to simulation results, in a case where the Mn distribution ratio is lower than 1, a low amount of Mn is contained in the cementite, and spheroidization rapidly proceeds like cementite that does not contain Mn. In this case, the spheroidizing treatment time is assumed to be about 3 hours.

Next, the Cr distribution ratio (Cr in terms of at % contained in cementite in pearlite÷Cr in terms of at % contained in ferrite in the pearlite) of the steel according to this embodiment will be described.

In order to further improve hardenability, there may be cases where the steel for cold forging contains Cr in addition to Mn described above. Cr also tends to segregate to cementite in pearlite. For example, at 600° C., the Cr distribution ratio in an equilibrium state is about 25, and at 550° C. which is the pearlitic transformation temperature, the Cr distribution ratio in an equilibrium state is about 60. In a cementite spheroidizing process, Cr needs to diffuse to ferrite and the like from cementite. Therefore, in a case where Cr is contained in the steel, a treatment time for cementite spheroidization increases. In addition, Cr is an alloying element that further suppresses spheroidization of cementite than Mn described above. For example, in a case where a steel containing Fe-0.8 wt % C-0.3 at % Mn and a steel containing Fe-0.8 wt % C-0.3 at % Cr are compared to each other, in the steel containing Cr, the spheroidizing treatment time of cementite is equal to or longer than 1.5 times that of the steel containing Mn.

In the steel according to this embodiment, in a case where Cr is contained in the steel, a value (Cr distribution ratio) obtained by dividing the Cr content in cementite in pearlite in terms of at % by the Cr content in ferrite in the pearlite in terms of at % is controlled to be higher than 0 and equal to or lower than 3.0. As a result, a cementite spheroidizing treatment time before cold forging can be preferably shortened. In addition, the Cr distribution ratio is a measurement value at room temperature. When the Cr distribution ratio measured at room temperature is in the above range, the Cr distribution ratio at a spheroidizing treatment temperature of the cementite becomes a preferable value with which the spheroidizing treatment time can be shortened.

In the steel according to this embodiment, as described above, the Mn distribution ratio is controlled to be higher than 0 and equal to or lower than 5.0. When the Mn distribution ratio is controlled as described above, the distribution ratio of alloying elements other than Mn, which are likely to segregate to the cementite, are also controlled in the same manner. Since Cr is also an alloying element that is likely to segregate to the cementite in the pearlite, the Cr distribution ratio is also controlled in the same manner when the Mn distribution ratio is controlled. Since Cr has a more significant effect on increasing the spheroidizing treatment time compared to Mn, when Cr is contained in the steel, the Cr distribution ratio is preferably controlled to be higher than 0 and equal to or lower than 3.0.

In order to check the relationship between the Cr distribution ratio before spheroidizing treatment and the treatment time for cementite spheroidization, a spheroidizing treatment time was examined by performing spheroidizing treatment of cementite at a treatment temperature of 700° C. As a result, in a case of a Cr distribution ratio of 3.0, the spheroidizing treatment time was about 9 hours, and in a case of a Cr distribution ratio of 3.1, the spheroidizing treatment time was longer than 9 hours. Therefore, in the steel according to this embodiment, the upper limit of the Cr distribution ratio is preferably set to 3.0 or lower.

In order to shorten the spheroidizing treatment time of cementite, a state in which Cr is not contained in the cementite at all is the most preferable. That is, the Cr distribution ratio is ideally 0. However, in a case where Cr is contained in the cementite, like Mn, Cr also becomes energetically stable. That is, it is industrially difficult to set the Cr distribution ratio to 0. Therefore, in the steel according to this embodiment, the lower limit of the Cr distribution ratio is set to be higher than 0. In addition, the lower limit of the Cr distribution ratio is more preferably 1.0. In addition, the upper limit of the Cr distribution ratio is lower than 3, and more preferably lower than 1.5.

Next, effects of alloying elements contained in the steel other than Mn and Cr on cementite spheroidization will be described.

Mo, V, and the like contained in the steel as the alloying elements lengthen the treatment time for cementite spheroidization. However, compared to Mn or Cr, Mo, V, and the like have a small effect on increasing the spheroidizing treatment time. In addition, the amounts of Mo and V in the steel according to this embodiment are small. Therefore, compared to Mn or Cr, Mo and V have a small effect on the spheroidizing treatment time of the cementite. However, the Mo distribution ratio (Mo in terms of at % contained in cementite in pearlite Mo in terms of at % contained in ferrite in the pearlite) and the V distribution ratio (V in terms of at % contained in cementite in pearlite÷V in terms of at % contained in ferrite in the pearlite) preferably have low values. Specifically, the Mo distribution ratio is preferably higher than 0 to 3, and the V distribution ratio is preferably higher than 0 to 15.

Next, the chemical composition of the steel according to this embodiment will be described.

The steel according to this embodiment includes, in the chemical composition, by mass %: C: 0.005% to 0.60%, Si: 0.01% to 0.50%, Mn: 0.20% to 1.80%, Al: 0.01% to 0.06%, P: 0.04% or less, S: 0.05% or less, N: 0.01% or less, Cr: 0% to 1.50%, Mo: 0% to 0.50%, Ni: 0% to 1.00%, V: 0% to 0.50%, B: 0% to 0.0050%, Ti: 0% to 0.05%, and Fe and impurities as the remainder.

In the chemical composition of the steel according to this embodiment, C, Si, Mn, and Al are basic elements.

C: 0.005% to 0.60%

C (carbon) is an element that improves the strength of steel. When the C content is less than 0.005%, strength required for a machine part cannot be secured. When the C content is more than 0.6%, cold workability or toughness are deteriorated. In addition, the lower limit of the C content may be 0.1%, 0.2%, or 0.3%. The upper limit of the C content may be 0.5%.

Si: 0.01% to 0.50%

Si (silicon) is a deoxidizing element during steelmaking and is an element which increases the strength or hardenability of steel. When the Si content is less than 0.01%, the effect becomes insufficient. When the Si content is more than 0.50%, strength is excessively increased, and toughness, ductility, and cold workability are deteriorated. In addition, the lower limit of the Si content may be 0.03%. The upper limit of the Si content may be 0.4%.

Mn: 0.20% to 1.80%

Mn (manganese) is an element that increases the strength or hardenability of steel. When the Mn content is less than 0.20%, the effect becomes insufficient. When the Mn content is more than 1.80%, strength is excessively increased, and toughness and cold workability are deteriorated. In addition, the transformation time increases and the productivity is deteriorated. In addition, the lower limit of the Mn content may be 0.3%. The upper limit of the Mn content may be 1.0%.

Al: 0.01% to 0.06%

Al (aluminum) is an element that is bound to N in steel and forms a compound. In addition, Al is an element that suppresses dynamic strain ageing during cold forging and reduces the deformation resistance. When the Al content is less than 0.01%, the effect becomes insufficient. When the Al content is more than 0.06%, toughness is deteriorated. In addition, the lower limit of the Al content may be more than 0.01% and may be 0.02%. The upper limit of the Al content may be 0.04%.

The steel according to this embodiment contains impurities in the chemical composition. In addition, "impurities" are those incorporated from ore and scrap as raw materials or due to a production environment when steel is industrially produced. Among the impurities, P, S, and N are preferably limited as follows in order to sufficiently exhibit the above-described effect. In addition, since a lower amount of impurities is preferable, the lower limit thereof does not need to be limited, and the lower limit of the impurities may be 0%.

P: 0.04% or Less

P (phosphorus) is an impurity. When the P content is more than 0.04%, P segregates to grain boundaries and thus toughness is deteriorated. Therefore, the P content may be limited to 0.04% or less. In consideration of current general refining (including secondary refining), the lower limit of the P content may be 0.002%.

S: 0.05% or Less

S (sulfur) is an impurity. When the S content is more than 0.05%, cold workability is deteriorated. Therefore, the S content may be limited to 0.05% or less. In consideration of current general refining (including secondary refining), the lower limit of the S content may be 0.001%.

N: 0.01% or Less

N (nitrogen) is an impurity. When the N content is more than 0.01%, workability is deteriorated. Therefore, the N content may be limited to 0.01% or less. Preferably, the N content may be limited to 0.005% or less. In consideration of current general refining (including secondary refining), the lower limit of the N content may be 0.002%.

As described above, the steel according to this embodiment contains the basic elements and Fe and the impurities as the remainder in the chemical composition. However, the steel according to this embodiment may contain, instead of a portion of Fe as the remainder, Cr Mo, Ni, V. B, and Ti as selective elements. Such selective elements may be contained according to purposes. Therefore, the lower limits of the selective elements do not need to be limited, and the lower limits thereof may be 0%. In addition, when the selective elements are contained as the impurities, the above-described effect is not degraded.

Cr: 0% to 1.50%

Mo: 0% to 0.50%

Ni: 0% to 1.00%

Cr (chromium), Mo (molybdenum), and Ni (nickel) are elements that increase the hardenability of steel. Therefore, as necessary, the Cr content may be 0% to 1.50%, the Mo content may be 0% to 0.50%, and the Ni content may be 0% to 1.00%. A preferable lower limit of the Cr content is 0.03%, a preferable lower limit of the Mo content is 0.01%, and a preferable lower limit of the Ni content is 0.01%. However, when the amount of each of the elements is more than the upper limit, ductility is deteriorated. In addition, the upper limit of the Cr content may be 1.00%, the upper limit of the Mo content may be 0.3%, and the upper limit of the Ni content may be 0.9%.

In addition, when Cr: 0.02% to 1.50% is satisfied, the Cr distribution ratio is preferably controlled to be higher than 0 and equal to or lower than 3.0.

V: 0% to 0.50%

V (vanadium) is an element that increases the strength of steel through precipitation hardening. Therefore, as necessary, the V content may be 0% to 0.50%. A preferable lower limit of the V content is 0.002%. However, when the V content is more than the upper limit, ductility is deteriorated. In addition, the upper limit of the V content may be 0.30%.

B: 0% to 0.0050%

B (boron) is an element that increases the hardenability of steel. Therefore, as necessary, the B content may be 0% to 0.0050%. A preferable lower limit of the B content is 0.0001%. However, when the B content becomes more than 0.005%, the effect is saturated. In addition, the upper limit of the B content may be 0.004%.

Ti: 0% to 0.05%

Ti (titanium) is an element that is bound to N in steel and forms a compound. In addition, Ti is an element that suppresses dynamic strain ageing during cold forging. Therefore, as necessary, the Ti content may be 0% to 0.05%. A preferable lower limit of the Ti content is 0.002%. However, when the Ti content becomes more than the upper limit, coarse TiN is precipitated, and cracking from TiN as the origin easily occurs. In addition, the upper limit of the Ti content may be 0.04%.

Next, the metallographic structure of the steel according to this embodiment will be described.

The metallographic structure of the steel according to this embodiment primarily contains pearlite. In addition, it is preferable that the metallographic structure thereof consists of pearlite. However, in order to control the steel to have the metallographic structure consisting of pearlite, the alloy composition of the steel is limited. Therefore, the metallographic structure may further contain proeutectoid ferrite or bainite in addition to pearlite. Specifically, when the carbon content expressed as mass % in the chemical composition of the steel is defined as C, in a cross section perpendicular to the longitudinal direction of the steel, the area fraction of the pearlite is equal to or higher than 130×C % and lower than 100%, and the area fraction of the sum of the proeutectoid ferrite and the bainite may be higher than 0% and equal to or lower than 100-130×C %. When this condition is satisfied, a reduction in the spheroidizing treatment time before cold forging and an improvement in cold workability can be preferably achieved at the same time. In addition, for the improvement in cold workability, the area fraction of the bainite is preferably lower than the area fraction of the proeutectoid ferrite. Similarly, the area fraction of martensite or retained austenite is preferably low. When the area fractions of the bainite, martensite, and retained austenite in the metallographic structure are low, there is a low possibility that the effects associated with this embodiment may be deteriorated. Specifically, the area fraction of the sum of the bainite, martensite, and retained austenite is preferably limited to 20% or less.

In the steel according to this embodiment, a reduction in the spheroidizing treatment time is one of the main purposes. During spheroidizing treatment, the aspect ratio of cementite is controlled to be 5 or lower on average. That is, the aspect ratio of the cementite contained in the steel according to this embodiment is higher than 5 on average before the spheroidizing treatment. Particularly, in a case where the aspect ratio of the cementite is 8 to 30, the effect of reducing the spheroidizing treatment time becomes significant. Therefore, in the steel according to this embodiment, the aspect ratio of the cementite before spheroidizing treatment may be 8 to 30.

Hereinafter, a measurement method of each characteristic value of the steel according to this embodiment will be described.

The chemical composition of the steel may be measured according to a general steel analysis method. For example, the chemical composition of the steel may be measured using ICP-AES (Inductively Coupled Plasma-Atomic Emission Spectrometry). However, C and S may be measured using a combustion-infrared absorption method, and N may be measured using an inert gas fusion-thermal conductivity detection method.

The Mn distribution ratio, the Cr distribution ratio, and the like of the steel may be measured using TEM-EDS. For example, at least 10 observation samples including both cementite and ferrite in pearlite are produced from the steel (steel wire rod) according to an FIB (Focused Ion Beam) method so that a cross section perpendicular to the longitudinal direction (C cross section, a cross section perpendicular to the wire drawing direction) becomes an observation surface. These observation samples are observed through TEM, and the amount (at %) of Mn or Cr is measured through EDS. In addition, by dividing the amount of Mn or Cr contained in the cementite by the amount of Mn or Cr contained in the ferrite, the Mn distribution ratio or the Cr distribution ratio is obtained.

FIG. 1 is an enlarged schematic view showing pearlite 1 contained in the steel according to this embodiment, and is a schematic view showing measurement points 4 for elemental analysis in ferrite 2 and cementite 3 in the pearlite 1. As shown in FIG. 1, the amount (at %) of Mn or Cr contained in the ferrite 2 and the cementite 3 in the pearlite 1 may be measured at each of the measurement points 4 in a square lattice with intervals of about 4 nm horizontally and 5 nm vertically. The integrated time for measurement at each of the measurement points 4 is set to 50 seconds. In addition, during data analysis, spectra are vertically integrated. Per one observation visual field, for both the cementite 3 and the ferrite 2, measurement is performed at at least 50 measurement points 4, the average value thereof is calculated, and the Mn distribution ratio or the Cr distribution ratio is obtained. In addition, the same measurement is performed using the 10 observation samples, and the average value of the Mn distribution ratio or the Cr distribution ratio is obtained. Specifically, the Mn distribution ratio or the Cr distribution ratio may be measured using the HF2000 field emission electron gun mounted transmission electron microscope manufactured by Hitachi, Ltd., or the like. In addition, the Mn distribution ratio or the Cr distribution ratio may also be measured using SEM-EDS (Scanning Electron Microscope-Energy Dispersive X-ray Spectroscopy).

The metallographic structure of the steel may be observed using SEM. For example, the steel (steel wire rod) is cut so that the cross section perpendicular to the longitudinal direction (C cross section, the cross section perpendicular to the wire drawing direction) becomes the observed section, and the observation surface is polished and corroded. In addition, when it is assumed that the distance of a line segment from one point on the contour line of the observation surface toward the centroid is D, a D portion (a portion near the center of the steel) on the observation surface, a 0.5 D portion (an intermediate portion between the center and the surface layer of the steel), and a portion near the contour line (a portion near the surface layer of the steel) are used as observation regions of the metallographic structure. A photograph of the metallographic structure is taken by setting an observation visual field in each of the observation regions to 125 μm×95 μm, and setting an observation magnification to 1000-fold. The photograph of the metallographic structure is taken from at least 5 visual fields that are different observation visual fields. Using the photograph of the metallographic structure, each constituent phase such as pearlite, proeutectoid ferrite, bainite, martensite, and retained austenite may be identified. In addition, as necessary, image analysis is performed using the photograph of the metallographic structure, and the average value of the area fractions of the constituent phases may be obtained. In addition, the area fraction of a microscopic inspection surface can be regarded as being the same as the volume fraction of the metallographic structure.

The aspect ratio of the cementite contained in the steel may be measured using SEM. Similar to the observation of the metallographic structure, the D portion on the observation surface, the 0.5 D portion, and the portion near the contour line are used as measurement regions of the aspect ratio of the cementite. A photograph of the metallographic structure is taken by setting an observation visual field in each of the observation regions to 25 μm×20 μm, and setting an observation magnification to 5000-fold. The photograph of the metallographic structure is taken from at least 5 visual fields that are different observation visual fields. Using the photograph of the metallographic structure, image analysis is performed, and the average value of the aspect ratio of the cementite is obtained. The aspect ratio of the cementite is a value obtained by dividing the major axis by the minor axis of the cementite.

Hereinafter, the difference between the steel according to this embodiment and a steel in the related art will be described.

In a technique disclosed in Japanese Unexamined Patent Application, First Publication No. 2010-159476, a reduction in a spheroidizing treatment time is achieved by controlling a steel to have a metallographic structure primarily containing pearlite and controlling the average block size of the pearlite to be 20 μm or smaller. In this technique, by refining the block size of the pearlite, the size of cementite is reduced, thereby promoting spheroidization of the cementite. In practice, spheroidization of the cementite is promoted by this technique. On the other hand, in the steel according to this embodiment, focusing on the amounts of alloying elements such as Mn and Cr contained in each of the cementite and the ferrite in the pearlite, the Mn distribution ratio or the Cr distribution ratio is controlled. Due to the control, the material properties of the cementite are essentially improved. As a result, an inhibition factor for the spheroidization of the cementite is fundamentally resolved, and a significant reduction in the spheroidizing treatment time can be realized.

In a technique disclosed in Japanese Unexamined Patent Application, First Publication No. 2009-275250, the metallographic structure of a steel after spheroidizing treatment is controlled to include ferrite having an average grain size of 15 μm or smaller and spherical cementite having an average aspect ratio of 3 or lower and an average grain size of 0.6 μm or smaller, and the number of particles of the spherical cementite is controlled to be $1.0\times10^6\times$C content (%) or greater per 1 $mm^2$. In this technique, the steel having excellent cold workability can be obtained. However, in the technique disclosed in Japanese Unexamined Patent Application, First Publication No. 2009-275250, there is a need to perform wire drawing with an area reduction of 40% or lower before the spheroidizing treatment. On the other hand, in the steel according to this embodiment, as described above, without performing wire drawing before the spheroidizing treatment, a reduction in the spheroidizing treatment time before cold forging and an improvement in cold workability can be simultaneously achieved.

As described above, in the steel according to this embodiment, a reduction in the spheroidizing treatment time can be achieved by preferably controlling the Mn distribution ratio or the Cr distribution ratio. Furthermore, in the steel according to this embodiment, cold workability is improved by preferably controlling the alloy composition or the metallographic structure. That is, in the steel according to this embodiment, by essentially improving the material properties of the cementite, a reduction in the spheroidizing treatment time and an improvement in cold workability can be simultaneously achieved.

Figure 2:
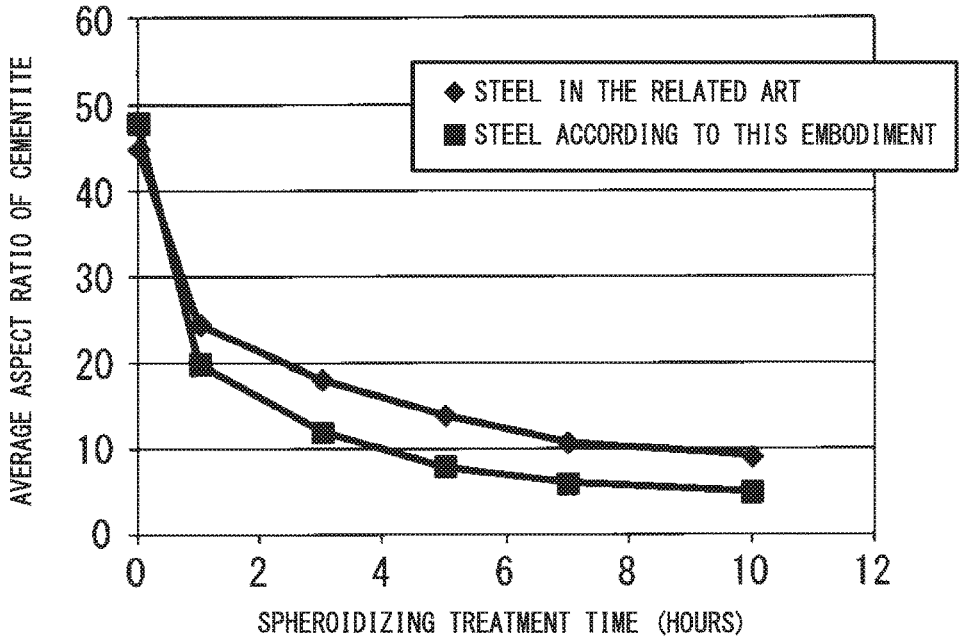
FIG. 2 shows the relationship between a spheroidizing treatment time and an average aspect ratio of the cementite.

FIG. 2 shows the relationship between the spheroidizing treatment time and the average aspect ratio of the cementite, which has been examined using the steel according to this embodiment and a steel in the related art. As shown in FIG. 2, in the steel according to this embodiment, compared to the steel in the related art, spheroidization easily proceeds, and the spheroidizing treatment time is significantly shortened.

Example 1

The effect of one embodiment of the present invention will be described in more detail using Examples. However, conditions of Examples are conditional examples employed to confirm the applicability and effect of the present invention, and the present invention is not limited to the conditional examples. The present invention may employ various conditions without departing from the gist of the present invention as long as the object of the present invention can be accomplished.

Steels No. 1 to No. 56 shown in Tables 1 to 9 were produced in a production method including a heating process, a hot rolling process, a winding process, a primary cooling process, a secondary cooling process, a retention process, and a tertiary cooling process. Detailed production conditions are shown in Tables 1 to 3. In addition, in the heating process, steel was heated to a temperature of 1000° C. or higher. In the hot rolling process, the steel was rolled into a steel (steel wire rod) having a wire diameter of 5.5 to 15.0 mm. In the primary cooling process and the secondary cooling process, the steel was cooled by being immersed in a molten salt bath of which the bath temperature was controlled. Cooling rates in the primary cooling process and the secondary cooling process were controlled by changing the cooling start temperature of the steel or the bath temperature of the molten salt bath. In the retention process, the steel was retained by being immersed in the molten salt bath of which the bath temperature was controlled so as to complete pearlitic transformation. In the tertiary cooling process, the steel was cooled through water cooling.

The chemical composition, the metallographic structure, the Mn distribution ratio, the Cr distribution ratio, and the aspect ratio of the cementite of the produced steel were measured according to the above-described method. Production results of the steels are shown in Tables 4 to 9. In addition, in Tables, underlined numerical values represent numerical values outside of the present invention, blanks represent that corresponding alloying elements are not added intentionally, and "-" represents "not performed".

In addition, although not shown in Tables, in Steels Nos. 2, 6, and 24, when the carbon content in the steels expressed as mass % is defined as C, in a cross section perpendicular to the longitudinal direction of the steels, the area fraction of the pearlite was equal to or higher than 130×C % and lower than 100%, and the area fraction of the sum of the proeutectoid ferrite and the bainite was higher than 0% and equal to or lower than 100-130×C %. In addition, the area fractions of the constituent phases of the metallographic structure were evaluated according to the above-described method.

In addition, cementite spheroidizing treatment was performed on the steels produced as above. Treatment conditions of the spheroidizing treatment are shown in Tables 7 to 9. In addition, the treatment time for the aspect ratio of the cementite in the steel (spheroidized material) after the spheroidizing treatment to become 5 or lower was examined. In addition, the aspect ratio of the spheroidized material was evaluated according to the above-described method. A steel in which the spheroidizing treatment time for causing the aspect ratio of the cementite to be 5 or lower is 9 hours or shorter was determined as achieving a reduction in the spheroidizing treatment time.

In addition, in order to evaluate cold workability, a tensile test was performed using the spheroidized material. In addition, the tensile test of the spheroidized material was conducted on the basis of JIS Z 2241: 2011 (or ISO 6892-1: 2009). In the tensile test, at least three tests were conducted using a 9A test piece, and the average values of tensile strengths and reductions of area were calculated. When the carbon content in the steel expressed as mass % is defined as C, a steel having a tensile strength of 530×C+300 or lower in the unit of MPa and a reduction of area of −35×C+89 or higher in the unit of % was determined as having excellent cold workability.

A spheroidizing treatment time and tensile characteristics for causing the aspect ratio of the cementite to be 5 or lower, which are evaluation results of the spheroidized materials, are shown in Tables 7 to 9.

As shown in Tables 1 to 9, in Nos. 2, 4, 6, 12, 14, 16, 20, 24, 26, 27, 29, 31, 43, 46, and 56, which are examples of the present invention, all of the chemical composition, the metallographic structure, and the Mn distribution ratio satisfied the range of the present invention. As a result, a reduction in the spheroidizing treatment time and an improvement in cold workability could be simultaneously achieved.

On the other hand, in Nos. 1, 3, 5, 7 to 11, 13, 15, 17 to 19, 21 to 23, 25, 28, 30, 32 to 42, 44, 45, and 47 to 55 which are comparative examples, any of the chemical composition, the metallographic structure, and the Mn distribution ratio did not satisfy the range of the present invention. As a result, a reduction in the spheroidizing treatment time and an improvement in cold workability could not be simultaneously achieved.

[Table 1]

[Table 2]

[Table 3]

[Table 4]

[Table 5]
[Table 6]
[Table 7]
[Table 8]
[Table 9]

INDUSTRIAL APPLICABILITY

According to the embodiment of the present invention, not only the alloy composition or the metallographic structure of the steel is controlled, but also the distribution ratio of the alloying elements in the cementite and the ferrite in the pearlite of the steel is preferably controlled. Therefore, the steel which simultaneously achieves a reduction in the spheroidizing treatment time before cold forging and an improvement in cold workability can be provided. Therefore, high industrial applicability is achieved.

BRIEF DESCRIPTION OF THE REFERENCE SYMBOLS

1 PEARLITE
2 FERRITE
3 CEMENTITE
4 MEASUREMENT POINT

TABLE 1

| | | PRODUCTION CONDITIONS OF STEEL | | | | | |
|---|---|---|---|---|---|---|---|
| | | WINDING | PRIMARY COOLING PROCESS | | | SECONDARY COOLING PROCESS | |
| CLASSIFICATION | STEEL NO. | TEMPERATURE IN WINDING PROCESS ° C. | COOLING START TEMPERATURE ° C. | COOLING END TEMPERATURE ° C. | COOLING RATE ° C./s | COOLING START TEMPERATURE ° C. | COOLING END TEMPERATURE ° C. |
| COMPARATIVE EXAMPLE | 1 | 800 | 800 | 700 | 150 | 700 | 580 |
| INVENTION EXAMPLE | 2 | 800 | 800 | 700 | 150 | 700 | 450 |
| COMPARATIVE EXAMPLE | 3 | 800 | 800 | 700 | 150 | 700 | 580 |
| INVENTION EXAMPLE | 4 | 800 | 800 | 700 | 150 | 700 | 450 |
| COMPARATIVE EXAMPLE | 5 | 800 | 800 | 700 | 150 | 700 | 550 |
| INVENTION EXAMPLE | 6 | 800 | 800 | 700 | 150 | 700 | 450 |
| COMPARATIVE EXAMPLE | 7 | 800 | 800 | 700 | 150 | 700 | 550 |
| COMPARATIVE EXAMPLE | 8 | 900 | 900 | 700 | 150 | 700 | 460 |
| COMPARATIVE EXAMPLE | 9 | 800 | 800 | 700 | 150 | 700 | 580 |
| COMPARATIVE EXAMPLE | 10 | 900 | 900 | 700 | 150 | 700 | 460 |
| COMPARATIVE EXAMPLE | 11 | 800 | 800 | 700 | 150 | 700 | 580 |
| INVENTION EXAMPLE | 12 | 800 | 800 | 700 | 150 | 700 | 450 |
| COMPARATIVE EXAMPLE | 13 | 800 | 800 | 700 | 150 | 700 | 580 |
| INVENTION EXAMPLE | 14 | 900 | 900 | 700 | 150 | 700 | 460 |
| COMPARATIVE EXAMPLE | 15 | 800 | 800 | 700 | 150 | 700 | 550 |
| INVENTION EXAMPLE | 16 | 800 | 800 | 700 | 150 | 700 | 450 |
| COMPARATIVE EXAMPLE | 17 | 800 | 800 | 700 | 150 | 700 | 550 |
| COMPARATIVE EXAMPLE | 18 | 900 | 900 | 700 | 150 | 700 | 460 |
| COMPARATIVE EXAMPLE | 19 | 800 | 800 | 700 | 150 | 700 | 550 |

| | | PRODUCTION CONDITIONS OF STEEL | | | | | |
|---|---|---|---|---|---|---|---|
| | | SECONDARY COOLING PROCESS | RETENTION PROCESS | | TERTIARY COOLING PROCESS | | |
| CLASSIFICATION | STEEL NO. | COOLING RATE ° C./s | RETENTION TEMPERATURE ° C. | RETENTION TIME SECOND | COOLING START TEMPERATURE ° C. | COOLING END TEMPERATURE ° C. | COOLING RATE ° C./s |
| COMPARATIVE EXAMPLE | 1 | 25 | 580 | 50 | 580 | 50 | 40 |
| INVENTION EXAMPLE | 2 | 30 | 450 | 30 | 450 | 50 | 40 |
| COMPARATIVE EXAMPLE | 3 | 20 | 580 | 50 | 580 | 50 | 40 |
| INVENTION EXAMPLE | 4 | 30 | 450 | 30 | 450 | 50 | 40 |
| COMPARATIVE EXAMPLE | 5 | 20 | 550 | 250 | 550 | 50 | 40 |
| INVENTION EXAMPLE | 6 | 30 | 450 | 30 | 450 | 50 | 40 |
| COMPARATIVE EXAMPLE | 7 | 20 | 550 | 250 | 550 | 50 | 40 |
| COMPARATIVE EXAMPLE | 8 | 25 | 460 | 50 | 460 | 50 | 40 |
| COMPARATIVE EXAMPLE | 9 | 20 | 580 | 50 | 580 | 50 | 40 |
| COMPARATIVE EXAMPLE | 10 | 25 | 460 | 50 | 460 | 50 | 40 |
| COMPARATIVE EXAMPLE | 11 | 20 | 580 | 50 | 580 | 50 | 40 |
| INVENTION EXAMPLE | 12 | 30 | 450 | 30 | 450 | 50 | 40 |
| COMPARATIVE EXAMPLE | 13 | 20 | 580 | 50 | 580 | 50 | 40 |
| INVENTION EXAMPLE | 14 | 25 | 460 | 50 | 460 | 50 | 40 |
| COMPARATIVE EXAMPLE | 15 | 20 | 550 | 250 | 550 | 50 | 40 |
| INVENTION EXAMPLE | 16 | 30 | 450 | 30 | 450 | 50 | 40 |
| COMPARATIVE EXAMPLE | 17 | 20 | 550 | 250 | 550 | 50 | 40 |
| COMPARATIVE EXAMPLE | 18 | 25 | 460 | 50 | 460 | 50 | 40 |
| COMPARATIVE EXAMPLE | 19 | 20 | 550 | 250 | 550 | 50 | 40 |

TABLE 2

| | | PRODUCTION CONDITIONS OF STEEL | | | | | |
|---|---|---|---|---|---|---|---|
| | | WINDING | PRIMARY COOLING PROCESS | | | SECONDARY COOLING PROCESS | |
| CLASSIFICATION | STEEL NO. | TEMPERATURE IN WINDING PROCESS ° C. | COOLING START TEMPERATURE ° C. | COOLING END TEMPERATURE ° C. | COOLING RATE ° C./s | COOLING START TEMPERATURE ° C. | COOLING END TEMPERATURE ° C. |
| INVENTION EXAMPLE | 20 | 800 | 800 | 700 | 150 | 700 | 450 |
| COMPARATIVE EXAMPLE | 21 | 800 | 800 | 700 | 150 | 700 | 550 |
| COMPARATIVE EXAMPLE | 22 | 900 | 900 | 700 | 150 | 700 | 460 |
| COMPARATIVE EXAMPLE | 23 | 800 | 800 | 700 | 150 | 700 | ROOM TEMPERATURE |
| INVENTION EXAMPLE | 24 | 800 | 800 | 700 | 150 | 700 | 500 |
| COMPARATIVE EXAMPLE | 25 | 800 | 800 | 700 | 150 | 700 | 500 |
| INVENTION EXAMPLE | 26 | 800 | 800 | 700 | 150 | 700 | 500 |
| INVENTION EXAMPLE | 27 | 800 | 800 | 700 | 150 | 700 | 500 |
| COMPARATIVE EXAMPLE | 28 | 800 | 800 | 700 | 150 | 700 | 500 |
| INVENTION EXAMPLE | 29 | 800 | 800 | 700 | 150 | 700 | 500 |
| COMPARATIVE EXAMPLE | 30 | 800 | 800 | 700 | 150 | 700 | 500 |
| INVENTION EXAMPLE | 31 | 800 | 800 | 700 | 150 | 700 | 500 |
| COMPARATIVE EXAMPLE | 32 | 800 | 800 | 700 | 150 | 700 | 500 |
| COMPARATIVE EXAMPLE | 33 | 800 | 800 | 700 | 150 | 700 | 500 |
| COMPARATIVE EXAMPLE | 34 | 800 | 800 | 700 | 150 | 700 | 500 |
| COMPARATIVE EXAMPLE | 35 | 800 | 800 | 700 | 150 | 700 | 500 |
| COMPARATIVE EXAMPLE | 36 | 800 | 800 | 700 | 150 | 700 | 500 |
| COMPARATIVE EXAMPLE | 37 | 800 | 800 | 700 | 150 | 700 | 500 |
| COMPARATIVE EXAMPLE | 38 | 800 | 800 | 700 | 150 | 700 | 500 |

| | | PRODUCTION CONDITIONS OF STEEL | | | | | |
|---|---|---|---|---|---|---|---|
| | | SECONDARY COOLING PROCESS | RETENTION PROCESS | | TERTIARY COOLING PROCESS | | |
| CLASSIFICATION | STEEL NO. | COOLING RATE ° C./s | RETENTION TEMPERATURE ° C. | RETENTION TIME SECOND | COOLING START TEMPERATURE ° C. | COOLING END TEMPERATURE ° C. | COOLING RATE ° C./s |
| INVENTION EXAMPLE | 20 | 30 | 450 | 30 | 450 | 50 | 40 |
| COMPARATIVE EXAMPLE | 21 | 20 | 550 | 250 | 550 | 50 | 40 |
| COMPARATIVE EXAMPLE | 22 | 25 | 460 | 50 | 460 | 50 | 40 |
| COMPARATIVE EXAMPLE | 23 | WATER COOLING | — | — | — | — | — |
| INVENTION EXAMPLE | 24 | 25 | 500 | 30 | 500 | 50 | 40 |
| COMPARATIVE EXAMPLE | 25 | 25 | 500 | 30 | 500 | 50 | 40 |
| INVENTION EXAMPLE | 26 | 25 | 500 | 30 | 500 | 50 | 40 |
| INVENTION EXAMPLE | 27 | 25 | 500 | 30 | 500 | 50 | 40 |
| COMPARATIVE EXAMPLE | 28 | 25 | 500 | 30 | 500 | 50 | 40 |
| INVENTION EXAMPLE | 29 | 25 | 500 | 30 | 500 | 50 | 40 |
| COMPARATIVE EXAMPLE | 30 | 25 | 500 | 30 | 500 | 50 | 40 |
| INVENTION EXAMPLE | 31 | 25 | 500 | 30 | 500 | 50 | 40 |
| COMPARATIVE EXAMPLE | 32 | 25 | 500 | 30 | 500 | 50 | 40 |
| COMPARATIVE EXAMPLE | 33 | 25 | 500 | 30 | 500 | 50 | 40 |
| COMPARATIVE EXAMPLE | 34 | 25 | 500 | 30 | 500 | 50 | 40 |
| COMPARATIVE EXAMPLE | 35 | 25 | 500 | 30 | 500 | 50 | 40 |
| COMPARATIVE EXAMPLE | 36 | 25 | 500 | 30 | 500 | 50 | 40 |
| COMPARATIVE EXAMPLE | 37 | 25 | 500 | 30 | 500 | 50 | 40 |
| COMPARATIVE EXAMPLE | 38 | 25 | 500 | 30 | 500 | 50 | 40 |

TABLE 3

| | | PRODUCTION CONDITIONS OF STEEL | | | | | |
|---|---|---|---|---|---|---|---|
| | | WINDING | PRIMARY COOLING PROCESS | | | SECONDARY COOLING PROCESS | |
| CLASSIFICATION | STEEL NO. | TEMPERATURE IN WINDING PROCESS ° C. | COOLING START TEMPERATURE ° C. | COOLING END TEMPERATURE ° C. | COOLING RATE ° C./s | COOLING START TEMPERATURE ° C. | COOLING END TEMPERATURE ° C. |
| COMPARATIVE EXAMPLE | 39 | 800 | 800 | 700 | 150 | 700 | 500 |
| COMPARATIVE EXAMPLE | 40 | 800 | 800 | 700 | 150 | 700 | 500 |

TABLE 3-continued

| | | | | | | | |
|---|---|---|---|---|---|---|---|
| COMPARATIVE EXAMPLE | 41 | 800 | 800 | 700 | 150 | 700 | 500 |
| COMPARATIVE EXAMPLE | 42 | 800 | 800 | 700 | 150 | 700 | 500 |
| INVENTION EXAMPLE | 43 | 800 | 800 | 700 | 150 | 700 | 500 |
| COMPARATIVE EXAMPLE | 44 | 800 | 800 | 700 | 150 | 700 | 500 |
| COMPARATIVE EXAMPLE | 45 | 800 | 800 | 700 | 150 | 700 | 500 |
| INVENTION EXAMPLE | 46 | 800 | 800 | 700 | 150 | 700 | 470 |
| COMPARATIVE EXAMPLE | 47 | 800 | 800 | 700 | 50 | 700 | 470 |
| COMPARATIVE EXAMPLE | 48 | 800 | 800 | 700 | 150 | 700 | 600 |
| COMPARATIVE EXAMPLE | 50 | 800 | 800 | 700 | 150 | 700 | 450 |
| COMPARATIVE EXAMPLE | 52 | 800 | 800 | 700 | 150 | 700 | 470 |
| COMPARATIVE EXAMPLE | 55 | 800 | 800 | 700 | 150 | 700 | 470 |
| INVENTION EXAMPLE | 56 | 900 | 900 | 700 | 300 | 700 | 450 |

| | | PRODUCTION CONDITIONS OF STEEL | | | | | |
|---|---|---|---|---|---|---|---|
| | | SECONDARY COOLING PROCESS | RETENTION PROCESS | | TERTIARY COOLING PROCESS COOLING | | |
| CLASSIFICATION | STEEL NO. | COOLING RATE ° C./s | RETENTION TEMPERATURE ° C. | RETENTION TIME SECOND | START TEMPERATURE ° C. | COOLING END TEMPERATURE ° C. | COOLING RATE ° C./s |
| COMPARATIVE EXAMPLE | 39 | 25 | 500 | 30 | 500 | 50 | 40 |
| COMPARATIVE EXAMPLE | 40 | 25 | 500 | 30 | 500 | 50 | 40 |
| COMPARATIVE EXAMPLE | 41 | 25 | 500 | 30 | 500 | 50 | 40 |
| COMPARATIVE EXAMPLE | 42 | 25 | 500 | 30 | 500 | 50 | 40 |
| INVENTION EXAMPLE | 43 | 25 | 500 | 30 | 500 | 50 | 40 |
| COMPARATIVE EXAMPLE | 44 | 25 | 500 | 30 | 500 | 50 | 40 |
| COMPARATIVE EXAMPLE | 45 | 25 | 500 | 30 | 500 | 50 | 40 |
| INVENTION EXAMPLE | 46 | 30 | 470 | 30 | 470 | 50 | 40 |
| COMPARATIVE EXAMPLE | 47 | 30 | 470 | 30 | 470 | 50 | 40 |
| COMPARATIVE EXAMPLE | 48 | 30 | 600 | 30 | 600 | 50 | 40 |
| COMPARATIVE EXAMPLE | 50 | 15 | 450 | 30 | 450 | 50 | 40 |
| COMPARATIVE EXAMPLE | 52 | 30 | 470 | 30 | 470 | 50 | 20 |
| COMPARATIVE EXAMPLE | 55 | 30 | 470 | 250 | 470 | 50 | 40 |
| INVENTION EXAMPLE | 56 | 35 | 450 | 200 | 450 | 50 | 40 |

TABLE 4

| | | EVALUATION RESULTS OF STEEL CHEMICAL COMPOSITION OF STEEL (MASS %) | | | | | | | | | | | | |
|---|---|---|---|---|---|---|---|---|---|---|---|---|---|---|
| CLASSIFICATION | STEEL NO. | C | Si | Mn | Al | P | S | N | Cr | Mo | Ni | V | B | Ti |
| COMPARATIVE EXAMPLE | 1 | 0.6 | 0.03 | 0.68 | 0.025 | 0.012 | 0.011 | 0.0032 | | | | | | |
| INVENTION EXAMPLE | 2 | 0.6 | 0.03 | 0.68 | 0.025 | 0.012 | 0.011 | 0.0032 | | | | | | |
| COMPARATIVE EXAMPLE | 3 | 0.18 | 0.05 | 0.73 | 0.016 | 0.015 | 0.018 | 0.0028 | | | | | | 0.032 |
| INVENTION EXAMPLE | 4 | 0.18 | 0.05 | 0.73 | 0.016 | 0.015 | 0.018 | 0.0028 | | | | | | 0.032 |
| COMPARATIVE EXAMPLE | 5 | 0.3 | 0.19 | 1.5 | 0.032 | 0.009 | 0.022 | 0.0029 | | 0.015 | 0.012 | | | |
| INVENTION EXAMPLE | 6 | 0.3 | 0.19 | 1.5 | 0.032 | 0.009 | 0.022 | 0.0029 | | 0.015 | 0.012 | | | |
| COMPARATIVE EXAMPLE | 7 | 0.42 | 0.25 | 2 | 0.036 | 0.012 | 0.034 | 0.0035 | | | | | | |
| COMPARATIVE EXAMPLE | 8 | 0.42 | 0.25 | 2 | 0.036 | 0.012 | 0.034 | 0.0035 | | | | | | |
| COMPARATIVE EXAMPLE | 9 | 0.45 | 0.3 | 0.15 | 0.027 | 0.019 | 0.009 | 0.0029 | | | | | | |
| COMPARATIVE EXAMPLE | 10 | 0.45 | 0.3 | 0.15 | 0.027 | 0.019 | 0.009 | 0.0029 | | | | | | |
| COMPARATIVE EXAMPLE | 11 | 0.6 | 0.02 | 0.66 | 0.015 | 0.021 | 0.025 | 0.0028 | 0.01 | | | | | |
| INVENTION EXAMPLE | 12 | 0.6 | 0.02 | 0.66 | 0.015 | 0.021 | 0.025 | 0.0028 | 0.02 | | | | | |
| COMPARATIVE EXAMPLE | 13 | 0.16 | 0.028 | 0.71 | 0.019 | 0.015 | 0.021 | 0.0034 | 0.08 | 0.01 | 0.01 | | | |
| INVENTION EXAMPLE | 14 | 0.16 | 0.028 | 0.71 | 0.019 | 0.015 | 0.021 | 0.0034 | 0.08 | 0.01 | 0.01 | | | |
| COMPARATIVE EXAMPLE | 15 | 0.31 | 0.15 | 0.83 | 0.037 | 0.016 | 0.034 | 0.0039 | 1 | | | | | |
| INVENTION EXAMPLE | 16 | 0.31 | 0.15 | 0.83 | 0.037 | 0.016 | 0.034 | 0.0039 | 1 | | | | | |
| COMPARATIVE EXAMPLE | 17 | 0.39 | 0.22 | 0.85 | 0.032 | 0.022 | 0.027 | 0.0029 | 2 | | | | | 0.028 |
| COMPARATIVE EXAMPLE | 18 | 0.39 | 0.22 | 0.85 | 0.032 | 0.022 | 0.027 | 0.0029 | 2 | | | | | 0.028 |
| COMPARATIVE EXAMPLE | 19 | 0.45 | 0.33 | 0.91 | 0.018 | 0.016 | 0.018 | 0.0034 | 0.3 | | | | | |

TABLE 5

| | | EVALUATION RESULTS OF STEEL CHEMICAL COMPOSITION OF STEEL (MASS %) | | | | | | | | | | | | |
|---|---|---|---|---|---|---|---|---|---|---|---|---|---|---|
| CLASSIFICATION | STEEL NO. | C | Si | Mn | Al | P | S | N | Cr | Mo | Ni | V | B | Ti |
| INVENTION EXAMPLE | 20 | 0.45 | 0.33 | 0.91 | 0.018 | 0.016 | 0.018 | 0.0034 | 0.3 | | | | | |
| COMPARATIVE EXAMPLE | 21 | 0.6 | 1 | 0.8 | 0.024 | 0.02 | 0.033 | 0.0031 | 0.15 | | | | | |

TABLE 5-continued

| CLASSIFICATION | STEEL NO. | EVALUATION RESULTS OF STEEL CHEMICAL COMPOSITION OF STEEL (MASS %) | | | | | | | | | | | | |
|---|---|---|---|---|---|---|---|---|---|---|---|---|---|---|
| | | C | Si | Mn | Al | P | S | N | Cr | Mo | Ni | V | B | Ti |
| COMPARATIVE EXAMPLE | 22 | 0.6 | 1 | 0.8 | 0.024 | 0.02 | 0.033 | 0.0031 | 0.15 | | | | | |
| COMPARATIVE EXAMPLE | 23 | 0.4 | 0.2 | 1.5 | 0.024 | 0.01 | 0.02 | 0.004 | 0.3 | | | | | |
| INVENTION EXAMPLE | 24 | 0.42 | 0.15 | 0.8 | 0.023 | 0.02 | 0.03 | 0.003 | | | | 0.2 | | |
| COMPARATIVE EXAMPLE | 25 | 0.43 | 0.17 | 0.76 | 0.027 | 0.015 | 0.03 | 0.004 | | | | 0.8 | | |
| INVENTION EXAMPLE | 26 | 0.42 | 0.14 | 0.82 | 0.025 | 0.021 | 0.033 | 0.003 | | | | | 0.002 | |
| INVENTION EXAMPLE | 27 | 0.41 | 0.15 | 0.76 | 0.027 | 0.027 | 0.037 | 0.004 | | | | | | 0.032 |
| COMPARATIVE EXAMPLE | 28 | 0.43 | 0.18 | 0.81 | 0.021 | 0.023 | 0.041 | 0.0045 | | | | | | 0.07 |
| INVENTION EXAMPLE | 29 | 0.43 | 0.17 | 0.82 | 0.018 | 0.023 | 0.031 | 0.004 | | | 0.32 | | | |
| COMPARATIVE EXAMPLE | 30 | 0.4 | 0.15 | 0.76 | 0.024 | 0.03 | 0.043 | 0.003 | | | 1.1 | | | |
| INVENTION EXAMPLE | 31 | 0.42 | 0.16 | 0.81 | 0.023 | 0.026 | 0.037 | 0.003 | | 0.12 | | | | |
| COMPARATIVE EXAMPLE | 32 | 0.39 | 0.14 | 0.78 | 0.022 | 0.015 | 0.035 | 0.004 | | 0.73 | | | | |
| COMPARATIVE EXAMPLE | 33 | 0.41 | 0.17 | 0.79 | 0.025 | 0.032 | 0.039 | 0.02 | | | | | | |
| COMPARATIVE EXAMPLE | 34 | 0.38 | 0.18 | 0.78 | 0.026 | 0.025 | 0.1 | 0.005 | | | | | | |
| COMPARATIVE EXAMPLE | 35 | 0.43 | 0.13 | 0.83 | 0.023 | 0.06 | 0.043 | 0.005 | | | | | | |
| COMPARATIVE EXAMPLE | 36 | 0.38 | 0.16 | 0.84 | 0.005 | 0.034 | 0.038 | 0.004 | | | | | | |
| COMPARATIVE EXAMPLE | 37 | 0.39 | 0.13 | 0.82 | 0.08 | 0.031 | 0.043 | 0.003 | | | | | | |
| COMPARATIVE EXAMPLE | 38 | 0.43 | 0.19 | 0.15 | 0.027 | 0.024 | 0.032 | 0.003 | | | | | | |

TABLE 6

| CLASSIFICATION | STEEL NO. | EVALUATION RESULTS OF STEEL CHEMICAL COMPOSITION OF STEEL (MASS %) | | | | | | | | | | | | |
|---|---|---|---|---|---|---|---|---|---|---|---|---|---|---|
| | | C | Si | Mn | Al | P | S | N | Cr | Mo | Ni | V | B | Ti |
| COMPARATIVE EXAMPLE | 39 | 0.45 | 0.18 | 2 | 0.024 | 0.026 | 0.034 | 0.004 | | | | | | |
| COMPARATIVE EXAMPLE | 40 | 0.43 | 0.005 | 0.83 | 0.018 | 0.029 | 0.036 | 0.004 | | | | | | |
| COMPARATIVE EXAMPLE | 41 | 0.41 | 0.72 | 0.8 | 0.026 | 0.027 | 0.033 | 0.004 | | | | | | |
| COMPARATIVE EXAMPLE | 42 | 0.38 | 0.17 | 0.84 | 0.025 | 0.022 | 0.031 | 0.003 | 1.7 | | | | | |
| INVENTION EXAMPLE | 43 | 0.42 | 0.17 | 0.78 | 0.023 | 0.026 | 0.034 | 0.003 | 0.52 | | | | | |
| COMPARATIVE EXAMPLE | 44 | 0.003 | 0.15 | 0.81 | 0.026 | 0.026 | 0.042 | 0.004 | | | | | | |
| COMPARATIVE EXAMPLE | 45 | 0.82 | 0.18 | 0.79 | 0.023 | 0.024 | 0.039 | 0.003 | | | | | | |
| INVENTION EXAMPLE | 46 | 0.42 | 0.21 | 0.75 | 0.027 | 0.023 | 0.042 | 0.003 | | | | | | |
| COMPARATIVE EXAMPLE | 47 | 0.42 | 0.21 | 0.75 | 0.027 | 0.023 | 0.042 | 0.003 | | | | | | |
| COMPARATIVE EXAMPLE | 48 | 0.42 | 0.21 | 0.75 | 0.027 | 0.023 | 0.042 | 0.003 | | | | | | |
| COMPARATIVE EXAMPLE | 50 | 0.42 | 0.21 | 0.75 | 0.027 | 0.023 | 0.042 | 0.003 | | | | | | |
| COMPARATIVE EXAMPLE | 52 | 0.42 | 0.21 | 0.75 | 0.027 | 0.023 | 0.042 | 0.003 | | | | | | |
| COMPARATIVE EXAMPLE | 55 | 0.42 | 0.21 | 0.75 | 0.027 | 0.023 | 0.042 | 0.003 | | | | | | |
| INVENTION EXAMPLE | 56 | 0.6 | 0.02 | 0.63 | 0.014 | 0.009 | 0.011 | 0.0028 | | | | | | |

TABLE 7

| CLASSIFICATION | STEEL NO. | EVALUATION RESULTS OF STEEL | | | | SPHEROIDIZING TREATMENT |
|---|---|---|---|---|---|---|
| | | METALLOGRAPHIC STRUCTURE OF STEEL | | | | |
| | | CONSTITUENT PHASE P: PEARLITE pF: PROEUTECTOID FERRITE B: BAINITE M: MARTENSITE | ASPECT RATIO OF CEMENTITE | DISTRIBUTION RATIO OF ALLOY ELEMENTS Mn DISTRIBUTION RATIO | DISTRIBUTION RATIO OF ALLOY ELEMENTS Cr DISTRIBUTION RATIO | CONDITIONS OF STEEL HEATING RATE ° C./s |
| COMPARATIVE EXAMPLE | 1 | P/pF/B | 34 | 9.6 | — | 180 |
| INVENTION EXAMPLE | 2 | P/pF/B | 28 | 2 | — | 180 |
| COMPARATIVE EXAMPLE | 3 | P/pF/B | 12 | 9.4 | — | 180 |
| INVENTION EXAMPLE | 4 | P/pF/B | 14 | 2 | — | 180 |
| COMPARATIVE EXAMPLE | 5 | P/pF/B | 24 | 8.7 | — | 180 |
| INVENTION EXAMPLE | 6 | P/pF/B | 31 | 2.1 | — | 180 |
| COMPARATIVE EXAMPLE | 7 | P/pF/B | 33 | 9.9 | — | 180 |
| COMPARATIVE EXAMPLE | 8 | P/pF/B | 32 | 3.1 | — | 180 |

TABLE 7-continued

| | | | | | | |
|---|---|---|---|---|---|---|
| COMPARATIVE EXAMPLE | 9 | P/pF/B | 26 | 9.1 | — | 180 |
| COMPARATIVE EXAMPLE | 10 | P/pF/B | 27 | 1.8 | — | 180 |
| COMPARATIVE EXAMPLE | 11 | P/pF/B | 29 | 9.8 | 19.8 | 180 |
| INVENTION EXAMPLE | 12 | P/pF/B | 33 | 2 | 1.1 | 180 |
| COMPARATIVE EXAMPLE | 13 | P/pF/B | 14 | 8.9 | 20.3 | 180 |
| INVENTION EXAMPLE | 14 | P/pF/B | 11 | 2.3 | 1.9 | 180 |
| COMPARATIVE EXAMPLE | 15 | P/pF/B | 26 | 8.6 | 20.4 | 180 |
| INVENTION EXAMPLE | 16 | P/pF/B | 24 | 1.9 | 1.4 | 180 |
| COMPARATIVE EXAMPLE | 17 | P/pF/B | 33 | 10.1 | 21.3 | 180 |
| COMPARATIVE EXAMPLE | 18 | P/pF/B | 34 | 2.7 | 2.8 | 180 |
| COMPARATIVE EXAMPLE | 19 | P/pF/B | 26 | 9.2 | 19.8 | 180 |

| | | SPHEROIDIZING | | EVALUATION RESULTS OF SPHEROIDIZED MATERIAL | | | |
|---|---|---|---|---|---|---|---|
| | | TREATMENT CONDITIONS OF STEEL | | TIME UNTIL COMPLETION | TENSILE TEST RESULTS | | |
| CLASSIFICATION | STEEL NO. | TREATMENT TEMPERATURE ° C. | COOLING METHOD | OF SPHEROIDIZING hour | TENSILE STRENGTH MPa | REDUCTION OF AREA % | NOTE |
| COMPARATIVE EXAMPLE | 1 | 680 | RAPID COOLING | 18 | 596 | 76 | |
| INVENTION EXAMPLE | 2 | 680 | RAPID COOLING | 9 | 573 | 74 | |
| COMPARATIVE EXAMPLE | 3 | 680 | RAPID COOLING | 17 | 383 | 89 | |
| INVENTION EXAMPLE | 4 | 680 | RAPID COOLING | 8.5 | 381 | 84 | |
| COMPARATIVE EXAMPLE | 5 | 700 | RAPID COOLING | 16.5 | 442 | 81 | |
| INVENTION EXAMPLE | 6 | 700 | RAPID COOLING | 8 | 443 | 79 | |
| COMPARATIVE EXAMPLE | 7 | 700 | RAPID COOLING | 18.5 | 580 | 62 | |
| COMPARATIVE EXAMPLE | 8 | 700 | RAPID COOLING | 8 | 573 | 63 | |
| COMPARATIVE EXAMPLE | 9 | 720 | RAPID COOLING | 15.5 | 512 | 79 | |
| COMPARATIVE EXAMPLE | 10 | 720 | RAPID COOLING | 8.5 | 509 | 81 | HARDENABILITY IS INSUFFICIENT |
| COMPARATIVE EXAMPLE | 11 | 680 | RAPID COOLING | 19 | 602 | 76 | |
| INVENTION EXAMPLE | 12 | 680 | RAPID COOLING | 9 | 606 | 79 | |
| COMPARATIVE EXAMPLE | 13 | 680 | RAPID COOLING | 19 | 382 | 86 | |
| INVENTION EXAMPLE | 14 | 680 | RAPID COOLING | 9 | 379 | 89 | |
| COMPARATIVE EXAMPLE | 15 | 700 | RAPID COOLING | 17 | 452 | 82 | |
| INVENTION EXAMPLE | 16 | 700 | RAPID COOLING | 8.5 | 449 | 83 | |
| COMPARATIVE EXAMPLE | 17 | 700 | RAPID COOLING | 21 | 587 | 72 | |
| COMPARATIVE EXAMPLE | 18 | 700 | RAPID COOLING | 8.5 | 574 | 73 | |
| COMPARATIVE EXAMPLE | 19 | 720 | RAPID COOLING | 16 | 521 | 79 | |

TABLE 8

| | | EVALUATION RESULTS OF STEEL | | | | SPHEROIDIZING |
|---|---|---|---|---|---|---|
| | | METALLOGRAPHIC STRUCTURE OF STEEL | | | | TREATMENT |
| | | CONSTITUENT PHASE P: PEARLITE | | DISTRIBUTION RATIO OF ALLOY ELEMENTS | | CONDITIONS OF STEEL |
| CLASSIFICATION | STEEL NO. | pF: PROEUTECTOID FERRITE B: BAINITE M: MARTENSITE | ASPECT RATIO OF CEMENTITE | Mn DISTRIBUTION RATIO | Cr DISTRIBUTION RATIO | HEATING RATE ° C./s |
| INVENTION EXAMPLE | 20 | P/pF/B | 29 | 2.3 | 1.1 | 180 |
| COMPARATIVE EXAMPLE | 21 | P/pF/B | 27 | 8.9 | 18.7 | 180 |
| COMPARATIVE EXAMPLE | 22 | P/pF/B | 28 | 2.8 | 2.1 | 180 |
| COMPARATIVE EXAMPLE | 23 | M/B | — | — | — | — |
| INVENTION EXAMPLE | 24 | P/pF/B | 32 | 2.4 | — | 180 |
| COMPARATIVE EXAMPLE | 25 | P/pF/B | 31 | 2.9 | — | 180 |
| INVENTION EXAMPLE | 26 | P/pF/B | 28 | 3.4 | — | 180 |
| INVENTION EXAMPLE | 27 | P/pF/B | 31 | 2.2 | — | 180 |
| COMPARATIVE EXAMPLE | 28 | P/pF/B | 27 | 2.4 | — | 180 |
| INVENTION EXAMPLE | 29 | P/pF/B | 25 | 2.8 | — | 180 |
| COMPARATIVE EXAMPLE | 30 | P/pF/B | 26 | 2.9 | — | 180 |
| INVENTION EXAMPLE | 31 | P/pF/B | 31 | 2.7 | — | 180 |
| COMPARATIVE EXAMPLE | 32 | M/pF/B/P | 34 | 3.3 | — | 180 |
| COMPARATIVE EXAMPLE | 33 | P/pF/B | 24 | 2.6 | — | 180 |
| COMPARATIVE EXAMPLE | 34 | P/pF/B | 26 | 2.4 | — | 180 |
| COMPARATIVE EXAMPLE | 35 | P/pF/B | 25 | 2.7 | — | 180 |
| COMPARATIVE EXAMPLE | 36 | P/pF/B | 26 | 2.9 | — | 180 |
| COMPARATIVE EXAMPLE | 37 | P/pF/B | 27 | 2.7 | — | 180 |
| COMPARATIVE EXAMPLE | 38 | P/pF/B | 26 | 2.2 | — | 180 |

| | | SPHEROIDIZING | | EVALUATION RESULTS OF SPHEROIDIZED MATERIAL | | | |
|---|---|---|---|---|---|---|---|
| | | TREATMENT CONDITIONS OF STEEL | | TIME UNTIL COMPLETION | TENSILE TEST RESULTS | | |
| CLASSIFICATION | STEEL NO. | TREATMENT TEMPERATURE ° C. | COOLING METHOD | OF SPHEROIDIZING hour | TENSILE STRENGTH MPa | REDUCTION OF AREA % | NOTE |
| INVENTION EXAMPLE | 20 | 720 | RAPID COOLING | 7.5 | 513 | 83 | |
| COMPARATIVE EXAMPLE | 21 | 720 | RAPID COOLING | 19 | 652 | 61 | |
| COMPARATIVE EXAMPLE | 22 | 720 | RAPID COOLING | 8.5 | 643 | 64 | |
| COMPARATIVE EXAMPLE | 23 | — | — | — | 712 | 45 | |
| INVENTION EXAMPLE | 24 | 680 | RAPID COOLING | 8 | 513 | 81 | |
| COMPARATIVE EXAMPLE | 25 | 680 | RAPID COOLING | 9 | 535 | 71 | |
| INVENTION EXAMPLE | 26 | 680 | RAPID COOLING | 8.5 | 501 | 78 | |
| INVENTION EXAMPLE | 27 | 680 | RAPID COOLING | 7.5 | 505 | 82 | |
| COMPARATIVE EXAMPLE | 28 | 680 | RAPID COOLING | 9 | 516 | 62 | |
| INVENTION EXAMPLE | 29 | 680 | RAPID COOLING | 7.5 | 510 | 81 | |

TABLE 8-continued

| | | | | | | | |
|---|---|---|---|---|---|---|---|
| COMPARATIVE EXAMPLE | 30 | 680 | RAPID COOLING | 8 | 498 | 73 | |
| INVENTION EXAMPLE | 31 | 680 | RAPID COOLING | 9 | 513 | 78 | |
| COMPARATIVE EXAMPLE | 32 | 680 | RAPID COOLING | 9 | 721 | 44 | |
| COMPARATIVE EXAMPLE | 33 | 680 | RAPID COOLING | 7.5 | 515 | 73 | |
| COMPARATIVE EXAMPLE | 34 | 680 | RAPID COOLING | 8.5 | 530 | 68 | |
| COMPARATIVE EXAMPLE | 35 | 680 | RAPID COOLING | 7 | 518 | 68 | |
| COMPARATIVE EXAMPLE | 36 | 680 | RAPID COOLING | 8.5 | 492 | 72 | |
| COMPARATIVE EXAMPLE | 37 | 680 | RAPID COOLING | 9 | 530 | 68 | |
| COMPARATIVE EXAMPLE | 38 | 680 | RAPID COOLING | 7.5 | 510 | 79 | HARDENABILITY IS INSUFFICIENT |

TABLE 9

| | | EVALUATION RESULTS OF STEEL | | | | SPHEROIDIZING TREATMENT |
|---|---|---|---|---|---|---|
| | | METALLOGRAPHIC STRUCTURE OF STEEL | | | | |
| | | CONSTITUENT PHASE P: PEARLITE | | DISTRIBUTION RATIO OF ALLOY ELEMENTS | | CONDITIONS OF STEEL |
| CLASSIFICATION | STEEL NO. | pF: PROEUTECTOID FERRITE B: BAINITE M: MARTENSITE | ASPECT RATIO OF CEMENTITE | Mn DISTRIBUTION RATIO | Cr DISTRIBUTION RATIO | HEATING RATE ° C./s |
| COMPARATIVE EXAMPLE | 39 | P/pF/B | 31 | 3.4 | — | 180 |
| COMPARATIVE EXAMPLE | 40 | P/pF/B | 27 | 2.7 | — | 180 |
| COMPARATIVE EXAMPLE | 41 | P/pF/B | 23 | 3.1 | — | 180 |
| COMPARATIVE EXAMPLE | 42 | M/pF/B/P | 32 | 2.9 | 2.7 | 180 |
| INVENTION EXAMPLE | 43 | P/pF/B | 26 | 2.4 | 2.3 | 180 |
| COMPARATIVE EXAMPLE | 44 | FERRITE | — | — | — | — |
| COMPARATIVE EXAMPLE | 45 | P/B | 36 | 3.1 | — | 180 |
| INVENTION EXAMPLE | 46 | P/pF/B | 32 | 2.3 | — | 180 |
| COMPARATIVE EXAMPLE | 47 | P/pF/B | 33 | 5.4 | — | 180 |
| COMPARATIVE EXAMPLE | 48 | P/pF/B | 37 | 8.3 | — | 180 |
| COMPARATIVE EXAMPLE | 50 | P/pF/B | 32 | 6.2 | — | 180 |
| COMPARATIVE EXAMPLE | 52 | P/pF/B | 27 | 6.4 | — | 180 |
| COMPARATIVE EXAMPLE | 55 | P/pF/B | 26 | 6.1 | — | 180 |
| INVENTION EXAMPLE | 56 | P | 29 | 2.4 | — | 180 |

| | | SPHEROIDIZING TREATMENT CONDITIONS OF STEEL | | EVALUATION RESULTS OF SPHEROIDIZED MATERIAL | | | |
|---|---|---|---|---|---|---|---|
| | | | | TIME UNTIL COMPLETION | TENSILE TEST RESULTS | | |
| CLASSIFICATION | STEEL NO. | TREATMENT TEMPERATURE ° C. | COOLING METHOD | OF SPHEROIDIZING hour | TENSILE STRENGTH MPa | REDUCTION OF AREA % | NOTE |
| COMPARATIVE EXAMPLE | 39 | 680 | RAPID COOLING | 9 | 562 | 63 | |
| COMPARATIVE EXAMPLE | 40 | 680 | RAPID COOLING | 8.5 | 507 | 79 | HARDENABILITY IS INSUFFICIENT |
| COMPARATIVE EXAMPLE | 41 | 680 | RAPID COOLING | 8 | 540 | 64 | |

TABLE 9-continued

| | | | | | | |
|---|---|---|---|---|---|---|
| COMPARATIVE EXAMPLE | 42 | 680 | RAPID COOLING | 8 | 726 | 46 |
| INVENTION EXAMPLE | 43 | 680 | RAPID COOLING | 7.5 | 511 | 81 |
| COMPARATIVE EXAMPLE | 44 | — | — | — | — | — |
| COMPARATIVE EXAMPLE | 45 | 680 | RAPID COOLING | 8.5 | 790 | 51 |
| INVENTION EXAMPLE | 46 | 680 | RAPID COOLING | 7 | 513 | 81 |
| COMPARATIVE EXAMPLE | 47 | 680 | RAPID COOLING | 14 | 513 | 82 |
| COMPARATIVE EXAMPLE | 48 | 680 | RAPID COOLING | 19 | 495 | 84 |
| COMPARATIVE EXAMPLE | 50 | 680 | RAPID COOLING | 16 | 513 | 79 |
| COMPARATIVE EXAMPLE | 52 | 680 | RAPID COOLING | 16 | 516 | 79 |
| COMPARATIVE EXAMPLE | 55 | 680 | RAPID COOLING | 18 | 499 | 79 |
| INVENTION EXAMPLE | 56 | 680 | RAPID COOLING | 9 | 575 | 76 |

The invention claimed is:

1. A steel comprising, in a chemical composition, by mass %:

C: 0.005% to 0.60%,
Si: 0.01% to 0.50%,
Mn: 0.20% to 1.80%,
Al: 0.01% to 0.06%,
P: 0.04% or less,
S: 0.05% or less,
N: 0.01% or less,
Cr: 0% to 1.50%,
Mo: 0% to 0.50%,
Ni: 0% to 1.00%,
V: 0% to 0.50%,
B: 0% to 0.0050%,
Ti: 0% to 0.05%, and
a remainder of Fe and impurities, wherein a metallographic structure contains a pearlite, and a value obtained by dividing an Mn content in a cementite in the pearlite in terms of at % by an Mn content in a ferrite in the pearlite in terms of at % is higher than 0 and equal to or lower than 5.0.

2. The steel according to claim 1, wherein the steel is a steel wire rod.

3. The steel according to claim 1, wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

4. The steel according to claim 1, wherein the metallographic structure consists of the pearlite, wherein the pearlite contains cementite and ferrite.

5. The steel according to claim 4, wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

6. The steel according to claim 4, wherein the steel is a steel wire rod.

7. The steel according to claim 1, wherein the metallographic structure further contains proeutectoid ferrite or bainite, and when a carbon content in the chemical composition by mass % is defined as C, in a cross section perpendicular to a longitudinal direction of the steel, an area fraction of the pearlite is equal to or higher than 130×C % and lower than 100%, and an area fraction of a sum of the proeutectoid ferrite and the bainite is higher than 0% and equal to or lower than 100-130×C %.

8. The steel according to claim 7, wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

9. The steel according to claim 7, wherein the steel is a steel wire rod.

10. The steel according to claim 1 comprising, in the chemical composition, by mass %:

Cr: 0.02% to 1.50%, wherein a value obtained by dividing a Cr content in the cementite in the pearlite in terms of at % by a Cr content in the ferrite in the pearlite in terms of at % is higher than 0 and equal to or lower than 3.0.

11. The steel according to claim 10, wherein the steel is a steel wire rod.

12. The steel according to claim 10, wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

13. The steel according to claim 10, wherein the metallographic structure further contains proeutectoid ferrite or bainite, and when a carbon content in the chemical composition by mass % is defined as C, in a cross section perpendicular to a longitudinal direction of the steel, an area fraction of the pearlite is equal to or higher than 130×C % and lower than 100%, and an area fraction of a sum of the proeutectoid ferrite and the bainite is higher than 0% and equal to or lower than 100-130×C %.

14. The steel according to claim 13,
wherein the steel is a steel wire rod.

15. The steel according to claim 13,
wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

16. The steel according to claim 15,
wherein the steel is a steel wire rod.

17. The steel according to claim 10,
wherein the metallographic structure consists of the pearlite, wherein the pearlite contains cementite and ferrite.

18. The steel according to claim 17,
wherein the steel is a steel wire rod.

19. The steel according to claim 17,
wherein when a carbon content in the chemical composition by mass % is defined as C, the steel has a tensile strength of 530×C+300 or lower in the unit of MPa and a reduction of area of −35×C+89 or higher in the unit of % after a spheroidizing treatment by which an aspect ratio of the cementite in the steel becomes 5 or lower.

20. The steel according to claim 19,
wherein the steel is a steel wire rod.

* * * * *